US010526765B2

(12) United States Patent
Fujii et al.

(10) Patent No.: US 10,526,765 B2
(45) **Date of Patent: *Jan. 7, 2020**

(54) WORK VEHICLE AND CONTROL METHOD

(71) Applicant: KOMATSU LTD., Tokyo (JP)

(72) Inventors: Yuto Fujii, Tokyo (JP); Haruki Nishiguchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 101 days.

This patent is subject to a terminal disclaimer.

(21) Appl. No.: 15/562,925

(22) PCT Filed: Nov. 9, 2016

(86) PCT No.: PCT/JP2016/083217

§ 371 (c)(1),
(2) Date: Sep. 29, 2017

(87) PCT Pub. No.: WO2018/087832

PCT Pub. Date: May 17, 2018

(65) Prior Publication Data

US 2018/0363269 A1 Dec. 20, 2018

(51) Int. Cl.

| | |
|---|---|
| ***E02F 3/32*** | (2006.01) |
| ***E02F 9/22*** | (2006.01) |
| ***E02F 3/43*** | (2006.01) |
| ***E02F 3/36*** | (2006.01) |
| ***E02F 9/26*** | (2006.01) |
| ***E02F 3/30*** | (2006.01) |

(52) U.S. Cl.

CPC ..... *E02F 3/43* (2013.01); *E02F 3/301* (2013.01); *E02F 3/32* (2013.01); *E02F 3/3677* (2013.01);

(Continued)

(58) Field of Classification Search

CPC ... E02F 3/32; E02F 3/435; E02F 3/425; E02F 3/963; E02F 9/2228; E02F 9/2267;

(Continued)

(56) References Cited

U.S. PATENT DOCUMENTS 8,909,439 B2 * 12/2014 Matsuyama ..... E02F 3/435 37/195
9,790,966 B2 * 10/2017 Akiyama ..... F15B 15/02

(Continued)

FOREIGN PATENT DOCUMENTS

JP H05-195554 A 8/1993
JP H11-190305 A 7/1999

(Continued)

*Primary Examiner* — Robert E Pezzuto
(74) *Attorney, Agent, or Firm* — Drinker Biddle & Reath LLP

(57) ABSTRACT

A work vehicle includes a bucket which can perform a tilting operation with a hydraulic oil, a valve adjusting a flow rate of the hydraulic oil having the bucket perform the tilting operation, an electromagnetic proportional control valve generating a pilot pressure guided to the valve, a controller outputting a current to the electromagnetic proportional control valve, and a first sensor for detecting the tilting operation. The controller detects a horizontal state of the bucket based on an output from the first sensor. The controller adjusts a value for the current output to the electromagnetic proportional control valve after the horizontal state of the bucket is detected, and starts calibration of data for predicting an operation speed of the bucket in the tilting operation.

12 Claims, 21 Drawing Sheets

(52) U.S. Cl.
CPC ..... *E02F 3/435* (2013.01); *E02F 9/2267* (2013.01); *E02F 9/264* (2013.01); *E02F 9/265* (2013.01)

(58) Field of Classification Search
CPC ..... E02F 9/2285; E02F 9/2296; E02F 9/264; E02F 9/2029; E02F 3/431; E02F 3/46; E02F 3/43; E02F 3/3677; E02F 3/301; E02F 9/265; F15B 15/02; F15B 19/002; F15B 19/02; F15B 11/04; F15B 11/17; F15B 13/043; F15B 21/14
USPC ..... 37/347, 348, 414; 172/2–11; 701/1, 50, 701/22, 90, 36, 29.1, 124, 33.1, 408, 454, 701/469, 536
See application file for complete search history.

(56) References Cited

U.S. PATENT DOCUMENTS

| | | | | |
|---|---|---|---|---|
| 2009/0090237 | A1* | 4/2009 | Nishikawa | E02F 9/2203 91/461 |
| 2009/0142201 | A1 | 6/2009 | Lin et al. | |
| 2012/0134848 | A1* | 5/2012 | Nelson | E02F 9/226 417/53 |
| 2014/0326039 | A1 | 11/2014 | Ikegami et al. | |
| 2015/0345114 | A1 | 12/2015 | Nomura et al. | |
| 2016/0069044 | A1 | 3/2016 | Takaura et al. | |
| 2016/0251835 | A1 | 9/2016 | Kitajima et al. | |
| 2016/0265187 | A1 | 9/2016 | Baba et al. | |
| 2016/0273194 | A1 | 9/2016 | Ikegami et al. | |
| 2016/0281331 | A1 | 9/2016 | Ikegami et al. | |

FOREIGN PATENT DOCUMENTS

| | | | |
|---|---|---|---|
| JP | 2001-117627 | A | 4/2001 |
| JP | 2014-074319 | A | 4/2014 |
| JP | 5635706 | B1 | 12/2014 |
| JP | 5823080 | B1 | 11/2015 |
| JP | 5865510 | B2 | 2/2016 |
| KR | 10-2015-0140274 | A | 12/2015 |
| KR | 10-2015-0140275 | A | 12/2015 |
| KR | 10-2015-0140278 | A | 12/2015 |
| KR | 10-2016-0021073 | A | 2/2016 |
| WO | WO-2015/129931 | A1 | 9/2015 |

* cited by examiner

FIG.10

| | PILOT PRESSURE [MPa] | CYLINDER SPEED V [mm/s] |
|---|---|---|
| POINT OF START OF MOVEMENT (POINT WHERE VALUE FOR COMMAND CURRENT IS AT Is [mA]) | Ps | Vf (Vf: FIXED VALUE) |
| POINT WHERE VALUE FOR COMMAND CURRENT IS AT Iz [mA] | Pz | Vz |
| DIFFERENCE | Pz−Ps | Vz−Vf |
| DIFFERENCE IN p−v TABLE BEFORE CALIBRATION | P8−P1 | V8−V1 |
| CALIBRATION RATIO | Rp (=(Pz−Ps)/(P8−P1)) | Rv (=(Vz−Vf)/(V8−V1)) |

FIG.11

(A)

951

| No. | PILOT PRESSURE [MPa] | CYLINDER SPEED V [mm/s] |
|---|---|---|
| 1 | Ps | V1 |
| 2 | P2-(P1-Ps) | V2 |
| 3 | P3-(P1-Ps) | V3 |
| 4 | P4-(P1-Ps) | V4 |
| 5 | P5-(P1-Ps) | V5 |
| 6 | P6-(P1-Ps) | V6 |
| 7 | P7-(P1-Ps) | V7 |
| 8 | P8-(P1-Ps) | V8 |
| 9 | P9 | V9 |
| 10 | P10 | V10 |

(B)

952

| DIFFERENCE | |
|---|---|
| PILOT PRESSURE [MPa] | CYLINDER SPEED V [mm/s] |
| P2-P1 | V2-V1 |
| P3-P2 | V3-V2 |
| P4-P3 | V4-V3 |
| P5-P4 | V5-V4 |
| P6-P5 | V6-V5 |
| P7-P6 | V7-V6 |
| P8-P7 | V8-V7 |
| P9-(P8-(P1-Ps)) | V9-V8 |
| P10-P9 | V10-V9 |

FIG.12

(A)

953

| CALIBRATED DIFFERENCE | |
|---|---|
| PILOT PRESSURE [MPa] | CYLINDER SPEED V [mm/s] |
| Dp1 (=(P2−P1)×Rp) | Dv1 (=(V2−V1)×Rv) |
| Dp2 (=(P3−P2)×Rp) | Dv2 (=(V3−V2)×Rv) |
| Dp3 (=(P4−P3)×Rp) | Dv3 (=(V4−V3)×Rv) |
| Dp4 (=(P5−P4)×Rp) | Dv4 (=(V5−V4)×Rv) |
| Dp5 (=(P6−P5)×Rp) | Dv5 (=(V6−V5)×Rv) |
| Dp6 (=(P7−P6)×Rp) | Dv6 (=(V7−V6)×Rv) |
| Dp7 (=(P8−P7)×Rp) | Dv7 (=(V8−V7)×Rv) |
| Dp8 (=(P9−(P8−(P1−Ps)))×Rp) | Dv8 (=(V9−V8)×Rv) |
| Dp9 (=(P10−P9)×Rp) | Dv9 (=(V10−V9)×Rv) |

(B)

923

| No. | PILOT PRESSURE [MPa] | CYLINDER SPEED V [mm/s] |
|---|---|---|
| 1 | Ps | V1 |
| 2 | Ps+Dp1 | V1+Dv1 |
| 3 | Ps+Dp1+Dp2 | V1+Dv1+Dv2 |
| 4 | Ps+Dp1+Dp2+Dp3 | V1+Dv1+Dv2+Dv3 |
| 5 | Ps+Dp1+Dp2+···+Dp4 | V1+Dv1+Dv2+···+Dv4 |
| 6 | Ps+Dp1+Dp2+···+Dp5 | V1+Dv1+Dv2+···+Dv5 |
| 7 | Ps+Dp1+Dp2+···+Dp6 | V1+Dv1+Dv2+···+Dv6 |
| 8 | Ps+Dp1+Dp2+···+Dp7 (=Pz) | V1+Dv1+Dv2+···+Dv7 (=Vz) |
| 9 | P9 | V1+Dv1+Dv2+···+Dv8 |
| 10 | P10 | V1+Dv1+Dv2+···+Dv9 (=V10') |

WORK VEHICLE AND CONTROL METHOD

TECHNICAL FIELD

The present invention relates to a work vehicle and a control method in a work vehicle.

BACKGROUND ART

As disclosed in International Publication WO2015/129931 (PTD 1), in a hydraulic excavator representing a work vehicle, restriction of an operation of a work implement has recently been controlled by calculating a speed limit of a cutting edge of a bucket in a vertical direction with respect to target excavation topography.

In work vehicles, various calibration operations are performed as appropriate in consideration of an individual difference among work vehicles. For example, Japanese Patent No. 5635706 (PTD 2) discloses an operation support apparatus for supporting initial calibration of a stroke length of a hydraulic cylinder.

As further shown in Japanese Patent Laying-Open No. 2014-74319 (PTD 3), a work vehicle of which bucket can perform a tilting operation has also been known.

CITATION LIST

Patent Document

PTD 1: International Publication WO2015/129931
PTD 2: Japanese Patent No. 5635706
PTD 3: Japanese Patent Laying-Open No. 2014-74319

SUMMARY OF INVENTION

Technical Problem

In order to accurately calculate a speed limit of a work implement in a work vehicle of which bucket can perform a tilting operation, data used for predicting an operation speed of a bucket in the tilting operation is preferably calibrated. Depending on an attitude of the bucket, however, data may not accurately be calibrated.

An object of the present invention is to provide a work vehicle and a control method allowing accurate calibration of data to be used for predicting an operation speed of a bucket in a tilting operation.

According to one aspect of the present invention, a work vehicle includes a bucket, a valve adjusting a flow rate of a hydraulic oil having the bucket perform a tilting operation, an electromagnetic proportional control valve generating a pilot pressure guided to the valve, a controller outputting a current to the electromagnetic proportional control valve, and a first sensor for detecting the tilting operation. The controller includes a storage unit storing data for predicting an operation speed of the bucket in the tilting operation, a detection unit detecting a horizontal state of the bucket based on an output from the first sensor, and a calibration unit adjusting a current value of the current output to the electromagnetic proportional control valve after detection of the horizontal state of the bucket and starting calibration of the data.

According to the configuration, after the bucket is in the horizontal state, a value for a current output to the electromagnetic proportional control valve is adjusted and calibration of data for predicting an operation speed of the bucket in the tilting operation is started. Therefore, the work vehicle can calibrate data without being affected by gravity applied to the bucket. Therefore, the work vehicle can accurately calibrate data.

Preferably, the bucket performs the tilting operation by pivoting around a pivot axis orthogonal to a bucket pin. The calibration unit adjusts a current value of the current output to the electromagnetic proportional control valve after detection of the horizontal state of a cutting edge of the bucket and the pivot axis and starts calibration of the data.

According to the configuration, the work vehicle can calibrate the data as being affected less by the gravity applied to the bucket than when the pivot axis is not horizontal.

Preferably, a second sensor measuring the pilot pressure generated by the electromagnetic proportional control valve is further included. The controller further includes a current value control unit increasing the current value of the current output to the electromagnetic proportional control valve after detection of the horizontal state of the bucket. The calibration unit specifies the pilot pressure at the time when the bucket starts moving based on outputs from the first sensor and the second sensor with increase in current value by the current value control unit. The calibration unit calibrates the data with the specified pilot pressure.

According to the configuration, the work vehicle can calibrate data for predicting a speed of the tilting operation with the pilot pressure generated by the electromagnetic proportional control valve.

Preferably, the data includes first data defining relation between the current value of the current output to the electromagnetic proportional control valve and the pilot pressure generated by the electromagnetic proportional control valve. The controller further includes a current value control unit increasing the current value of the current output to the electromagnetic proportional control valve after detection of the horizontal state of the bucket. The calibration unit specifies the current value at the time when the bucket starts the tilting operation based on a result of detection by the first sensor with increase in current value by the current value control unit. The calibration unit specifies the pilot pressure corresponding to the specified current value based on the first data. The calibration unit calibrates the data with the specified pilot pressure.

According to the configuration, the work vehicle can calibrate data for predicting an operation speed of the bucket in the tilting operation with the specified current value and the first data defining relation between a value for the current output to the electromagnetic proportional control valve and a pilot pressure generated by the electromagnetic proportional control valve.

Preferably, the bucket can perform the tilting operation in a first direction and a second direction opposite to the first direction. The calibration unit specifies a current value at the time when the bucket starts the tilting operation in the first direction and a current value at the time when the bucket starts the tilting operation in the second direction.

According to the configuration, the work vehicle can measure a value for a command current at the time when the bucket starts the tilting operation in the first direction and a value for a command current at the time when the bucket starts the tilting operation in the second direction.

Preferably, the work vehicle further includes a cylinder for having the bucket perform the tilting operation. The cylinder includes a first cylinder having the bucket perform the tilting operation in a first direction by extending and a second cylinder having the bucket perform the tilting operation in a second direction by extending. The valve includes a first valve adjusting a flow rate of the hydraulic oil supplied to the first cylinder and a second valve adjusting a flow rate of the hydraulic oil supplied to the second cylinder. The electromagnetic proportional control valve includes a first electromagnetic proportional control valve generating a pilot pressure guided to the first valve and a second electromagnetic proportional control valve generating a pilot pressure guided to the second valve. The current value control unit increases a current value of the current output to the second electromagnetic proportional control valve after it increases a current value of the current output to the first electromagnetic proportional control valve.

According to the configuration, the work vehicle can specify a current value at the time when the bucket starts the tilting operation in the first direction, of the command current output to the first electromagnetic proportional control valve for having the bucket perform the tilting operation in the first direction. The work vehicle can specify a current value at the time when the bucket starts the tilting operation in the second direction, of the command current output to the second electromagnetic proportional control valve for having the bucket perform the tilting operation in the second direction.

Preferably, the work vehicle further includes an operation apparatus for operating the bucket. The data includes second data defining relation between the pilot pressure and an operation speed of the first cylinder and third data defining relation between the pilot pressure and an operation speed of the second cylinder. The calibration unit calibrates the second data and the third data on the condition that the operation apparatus accepts an operation for having the bucket perform the tilting operation.

According to the configuration, on the condition that an operation onto the operation apparatus is performed, the second data and the third data are calibrated. Therefore, the work vehicle can calibrate data for predicting an operation speed of the bucket in the tilting operation with an intention of an operator being accurately reflected.

Preferably, the current value control unit predicts an operation speed of the bucket in the tilting operation by using the first data and the second data on the condition that an operation mode of the work vehicle is set to the first operation mode and restricts the current value of the current output to the electromagnetic proportional control valve based on a result of prediction. The current value control unit increases stepwise the current value of the current output to the electromagnetic proportional control valve after detection of the horizontal state of the bucket on the condition that the operation mode of the work vehicle is set to a second operation mode.

According to the configuration, when the work vehicle is set to the first operation mode, predictive control using the second data and the third data is carried out. When the work vehicle is set to the second operation mode, a value for the command current at the time when the bucket starts the tilting operation can be measured.

According to another aspect of the present invention, a control method is performed in a work vehicle. The work vehicle includes a bucket, a valve adjusting a flow rate of a hydraulic oil having the bucket perform a tilting operation, an electromagnetic proportional control valve generating a pilot pressure guided to the valve, a controller outputting a current to the electromagnetic proportional control valve, and a sensor for detecting the tilting operation. The control method includes detecting, by the controller, a horizontal state of the bucket and adjusting, by the controller, a current value of the current output to the electromagnetic proportional control valve after detection of the horizontal state of the bucket and starting calibration of data for predicting an operation speed of the bucket in the tilting operation.

According to the configuration, after the bucket is in the horizontal state, a value for a current output to the electromagnetic proportional control valve is adjusted and calibration of data for predicting an operation speed of the bucket in the tilting operation is started. Therefore, data can be calibrated without being affected by gravity applied to the bucket. Therefore, data can accurately be calibrated.

Advantageous Effects of Invention

According to the invention, data used for predicting an operation speed of a bucket in a tilting operation can accurately be calibrated.

BRIEF DESCRIPTION OF DRAWINGS

FIG. 10 is a diagram for illustrating a technique for calculating a calibration ratio.

FIG. 11 is a diagram for illustrating a data table obtained by calculation processing.

FIG. 12 is a diagram showing calibrated data.

DESCRIPTION OF EMBODIMENTS

Figure 1:
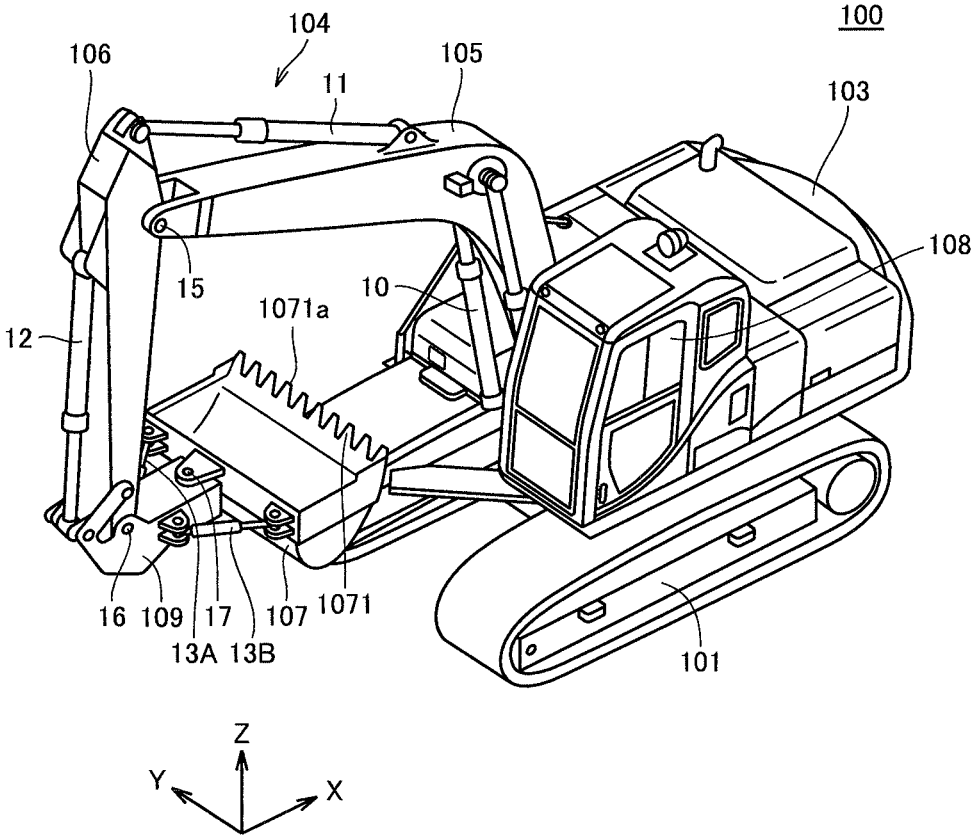
FIG. 1 is a diagram illustrating appearance of a work vehicle based on an embodiment.

An embodiment will be described hereinafter with reference to the drawings. In the description below, the same elements have the same reference characters allotted. Their label and function are also identical. Therefore, detailed description thereof will not be repeated.

Combination of features in the embodiment as appropriate is originally intended. Some constituent elements may not be used.

A work vehicle will be described below with reference to the drawings. In the description below, "above", "below", "front", "rear", "left", "right", "clockwise", and "counterclockwise" are terms with an operator seated at an operator's seat of a work vehicle being defined as the reference.

<A. Overall Construction>

FIG. 1 is a diagram illustrating appearance of a work vehicle 100 based on an embodiment.

As shown in FIG. 1, in the present example, a hydraulic excavator will mainly be described by way of example of work vehicle 100.

Work vehicle 100 mainly has a travel unit 101, a revolving unit 103, and a work implement 104. A main body of the work vehicle is constituted of travel unit 101 and revolving unit 103. Travel unit 101 has a pair of left and right crawler belts. Revolving unit 103 is revolvably attached with a revolving mechanism above travel unit 101 being interposed. Revolving unit 103 includes an operator's cab 108.

Work implement 104 is pivotally supported by revolving unit 103 as being operable in an upward/downward direction and performs such an operation as excavation of soil. Work implement 104 operates with a hydraulic oil supplied from a hydraulic pump (see FIG. 2). Work implement 104 includes a boom 105, an arm 106, a bucket 107, a boom cylinder 10, an arm cylinder 11, a bucket cylinder 12, and tilt cylinders 13A and 13B.

A base end portion of boom 105 is movably coupled to revolving unit 103 with a not-shown boom pin being interposed. A base end portion of arm 106 is movably attached to a tip end portion of boom 105 with an arm pin 15 being interposed. A coupling member 109 is attached to a tip end portion of arm 106 with a bucket pin 16 being interposed.

Coupling member 109 is attached to bucket 107 with a tilt pin 17 being interposed. Coupling member 109 is coupled to bucket cylinder 12 with a not-shown pin being interposed. Coupling member 109 allows movement of bucket 107 as a result of extension and contraction of bucket cylinder 12.

A boom pin, arm pin 15, and bucket pin 16 are arranged in such positional relation as being in parallel to one another.

Bucket 107 is called a tilting bucket. Bucket 107 is coupled to arm 106 with coupling member 109 and bucket pin 16 being interposed. In coupling member 109, bucket 107 is attached on a side of bucket 107 opposite to a side of coupling member 109 where bucket pin 16 is attached, with tilt pin 17 being interposed.

Tilt pin 17 is orthogonal to bucket pin 16. Thus, bucket 107 is attached to coupling member 109 with tilt pin 17 being interposed so as to be pivotable around a central axis of tilt pin 17. According to such a structure, bucket 107 can pivot around a central axis of bucket pin 16 and around the central axis of tilt pin 17. An operator can incline a cutting edge 1071*a* with respect to the ground by pivoting bucket 107 around the central axis of tilt pin 17.

Bucket 107 includes a plurality of blades 1071. The plurality of blades 1071 are attached to an end portion of bucket 107 opposite to a side where tilt pin 17 is attached. The plurality of blades 1071 are disposed in a direction orthogonal to tilt pin 17. The plurality of blades 1071 are aligned. Cutting edges 1071*a* of the plurality of blades 1071 are also aligned.

Figure 2:
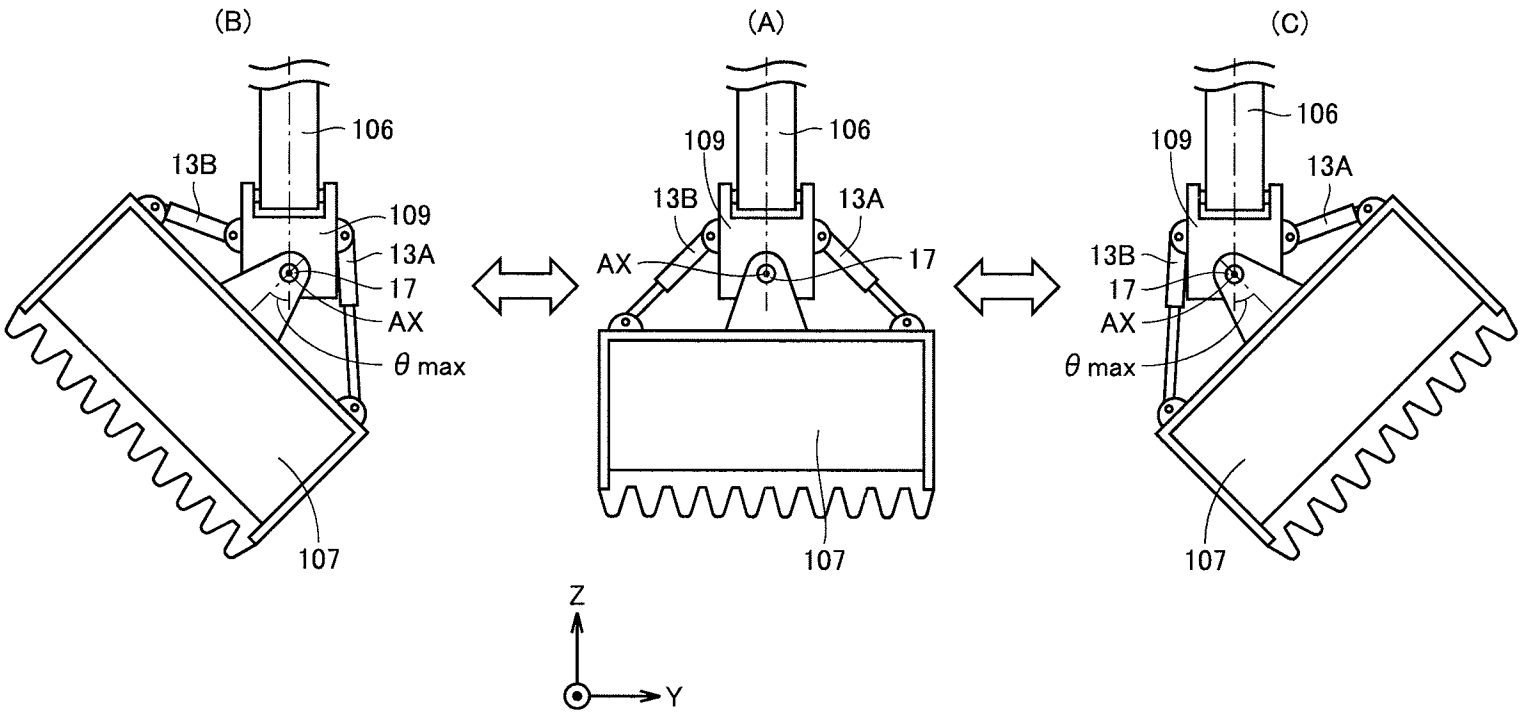
FIG. 2 is a diagram for illustrating a tilting operation of a bucket.

FIG. 2 is a diagram for illustrating a tilting operation of the bucket.

As shown in FIG. 2, tilt cylinder 13A couples bucket 107 and coupling member 109 to each other. A tip end of a cylinder rod of tilt cylinder 13A is coupled to a main body side of bucket 107 and a cylinder tube side of tilt cylinder 13A is coupled to coupling member 109.

Tilt cylinder 13B couples bucket 107 and coupling member 109 to each other similarly to tilt cylinder 13A. A tip end of a cylinder rod of tilt cylinder 13B is coupled to a main body side of bucket 107 and a cylinder tube side of tilt cylinder 13B is coupled to coupling member 109.

As shown as transition from a state (A) to a state (B), tilt cylinder 13B contracts with extension of tilt cylinder 13A so that bucket 107 pivots around tilt pin 17 clockwise with a pivot axis AX being defined as the center of pivot. As shown as transition from the state (A) to a state (C), tilt cylinder 13A contracts with extension of tilt cylinder 13B so that bucket 107 pivots counterclockwise around tilt pin 17 with pivot axis AX being defined as the center of pivot. Thus, bucket 107 pivots clockwise and counterclockwise around pivot axis AX.

Tilt cylinders 13A and 13B can be extended or contracted by a not-shown operation apparatus in operator's cab 108. As an operator of work vehicle 100 operates the operation apparatus, a hydraulic oil is supplied to or discharged from tilt cylinders 13A and 13B so that tilt cylinders 13A and 13B extend or contract. Consequently, bucket 107 pivots (is tilted) clockwise or counterclockwise by an amount in accordance with an amount of operation.

The operation apparatus includes, for example, an operation lever, a slide switch, or a foot pedal. An example in which an operation apparatus includes an operation lever and an operation detector detecting an operation of the operation lever will be described below by way of example.

Though two tilt cylinders 13A and 13B couple bucket 107 and coupling member 109 to each other on both of left and right sides of them in the present embodiment, at least one tilt cylinder should only couple them to each other.

<B. Hardware Configuration>

Figure 3:
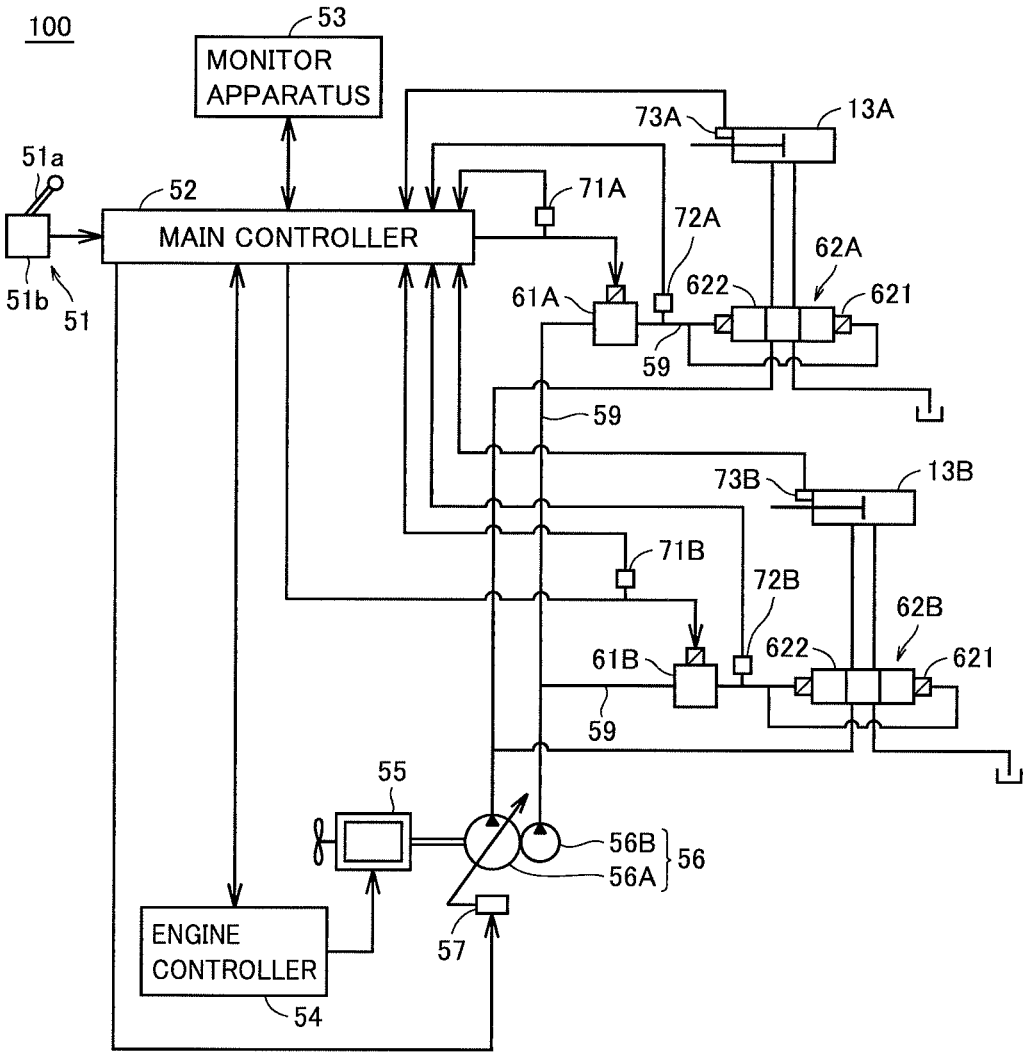
FIG. 3 is a diagram showing a hardware configuration of the work vehicle.

FIG. 3 is a diagram showing a hardware configuration of work vehicle 100.

As shown in FIG. 3, work vehicle 100 includes tilt cylinders 13A and 13B, an operation apparatus 51, a main controller 52, a monitor apparatus 53, an engine controller 54, an engine 55, a hydraulic pump 56, a swash plate driving apparatus 57, a pilot oil path 59, electromagnetic proportional control valves 61A and 61B, main valves 62A and 62B, sensors 71A and 71B, sensors 72A and 72B, and sensors 73A and 73B. Hydraulic pump 56 has a main pump 56A supplying a hydraulic oil to work implement 104 and a pilot pump 56B directly supplying oil to electromagnetic proportional control valves 61A and 61B. The electromagnetic proportional control valve is also called an EPC valve.

Operation apparatus 51 includes an operation lever 51*a* and an operation detector 51*b* detecting an amount of operation of operation lever 51*a*. Main valves 62A and 62B each have a spool 621 and a pilot chamber 622. Main valves 62A and 62B adjust a flow rate of a hydraulic oil operating work implement 104. Specifically, main valves 62A and 62B adjust a flow rate of a hydraulic oil having the bucket perform a tilting operation.

Monitor apparatus 53 is communicatively connected to main controller 52. Monitor apparatus 53 shows an engine state of work vehicle 100, guidance information, or warning information. Monitor apparatus 53 accepts an instruction for setting in connection with various operations of work vehicle 100. Monitor apparatus 53 notifies main controller 52 of an accepted instruction for setting. A specific example of contents of representation on monitor apparatus 53 and an instruction for setting will be described later.

Operation apparatus 51 is an apparatus for operating work implement 104. In the present example, operation apparatus 51 is an electronic apparatus for having bucket 107 perform a tilting operation. When an operator of work vehicle 100 operates operation lever 51*a*, operation detector 51*b* outputs an electric signal in accordance with a direction of operation and an amount of operation of operation lever 51*a* to main controller 52.

Engine 55 has a driveshaft for connection to hydraulic pump 56. As engine 55 rotates, a hydraulic oil is discharged from hydraulic pump 56. Engine 55 is a diesel engine by way of example.

Engine controller 54 controls an operation of engine 55 in accordance with an instruction from main controller 52. Engine controller 54 adjusts a speed of engine 55 by controlling an amount of injection of fuel injected by a fuel injection apparatus in accordance with an instruction from main controller 52. Engine controller 54 adjusts an engine speed of engine 55 in accordance with a control instruction from main controller 52 for hydraulic pump 56.

Main pump 56A delivers a hydraulic oil used for driving work implement 104. Swash plate driving apparatus 57 is connected to main pump 56A. Pilot pump 56B delivers a hydraulic oil to electromagnetic proportional control valves 61A and 61B.

Swash plate driving apparatus 57 is driven based on an instruction from main controller 52 and changes an angle of inclination of a swash plate of main pump 56A.

Main controller 52 is a controller for overall control of work vehicle 100 and implemented by a central processing unit (CPU), a non-volatile memory, and a timer. Main controller 52 controls engine controller 54 and monitor apparatus 53.

Main controller 52 outputs a current (a command current) operating electromagnetic proportional control valves 61A and 61B in accordance with an operation of operation lever 51*a* to electromagnetic proportional control valves 61A and 61B. When the operation lever is operated in a first direction, main controller 52 outputs a current having a value in accordance with an amount of operation to electromagnetic proportional control valve 61A. When the operation lever is operated in a second direction opposite to the first direction, main controller 52 outputs a current having a value in accordance with an amount of operation to electromagnetic proportional control valve 61B.

Though a configuration in which main controller 52 and engine controller 54 are separate from each other is described in the present example, they may be implemented as one common controller.

Electromagnetic proportional control valve 61A generates a pilot pressure (a command pilot pressure) guided to main valve 62A. Electromagnetic proportional control valve 61A is provided in pilot oil path 59 connecting pilot pump 56B and pilot chamber 622 of main valve 62A to each other, and generates a pilot pressure with a source pressure input from pilot pump 56B being used as a primary pressure. An oil is directly supplied from pilot pump 56B to electromagnetic proportional control valve 61A. Electromagnetic proportional control valve 61A generates a pilot pressure in accordance with a current value. Electromagnetic proportional control valve 61A drives spool 621 of main valve 62A with the pilot pressure.

Main valve 62A is provided between electromagnetic proportional control valve 61A and tilt cylinder 13A having bucket 107 perform a tilting operation. Main valve 62A supplies a hydraulic oil in an amount in accordance with a position of spool 621 to tilt cylinder 13A.

Electromagnetic proportional control valve 61B is provided in pilot oil path 59 connecting pilot pump 56B and pilot chamber 622 of main valve 62B to each other, and generates a pilot pressure (a command pilot pressure) with a source pressure input from pilot pump 56B being used as a primary pressure. An oil is directly supplied from pilot pump 56B to electromagnetic proportional control valve 61B, similarly to electromagnetic proportional control valve 61A. Electromagnetic proportional control valve 61B generates a pilot pressure in accordance with a current value. Electromagnetic proportional control valve 61B drives spool 621 of main valve 62B with the pilot pressure.

Main valve 62B is provided between electromagnetic proportional control valve 61B and tilt cylinder 13B having bucket 107 perform a tilting operation. Main valve 62B supplies a hydraulic oil in an amount in accordance with a position of spool 621 to tilt cylinder 13B.

Thus, electromagnetic proportional control valve 61A controls a flow rate of a hydraulic oil supplied to tilt cylinder 13A with the pilot pressure. Electromagnetic proportional control valve 61B controls a flow rate of a hydraulic oil supplied to tilt cylinder 13B with the pilot pressure.

Sensor 71A measures a value for a current output from main controller 52 to electromagnetic proportional control valve 61A and outputs a result of measurement to main controller 52. Sensor 71B measures a value for a current output from main controller 52 to electromagnetic proportional control valve 61B and outputs a result of measurement to main controller 52.

Sensor 72A measures a pilot pressure output from electromagnetic proportional control valve 61A to main valve 62A and outputs a result of measurement to main controller 52. Sensor 72B measures a pilot pressure output from electromagnetic proportional control valve 61B to main valve 62B and outputs a result of measurement to main controller 52.

Sensors 73A and 73B are sensors for detecting an operation of work implement 104. Specifically, sensor 73A is a sensor for detecting an operation of tilt cylinder 13A. Sensor 73B is a sensor for detecting an operation of tilt cylinder 13B. With an output from sensor 73A, main controller 52 determines a position of a rod of tilt cylinder 13A. Main controller 52 detects an operation speed of tilt cylinder 13A based on change in position of the rod (an amount of contraction of the rod). With an output from sensor 73B, main controller 52 determines a position of a rod of tilt cylinder 13B. Main controller 52 detects an operation speed of tilt cylinder 13B based on change in position of the rod (an amount of contraction of the rod).

In work vehicle 100, pilot pressures in accordance with values for currents output from main controller 52 to electromagnetic proportional control valves 61A and 61B are output from electromagnetic proportional control valves 61A and 61B to main valves 62A and 62B. In work vehicle 100, tilt cylinders 13A and 13B move at a speed in accordance with the pilot pressures output from electromagnetic proportional control valves 61A and 61B to main valves 62A and 62B. Therefore, in work vehicle 100, tilt cylinders 13A and 13B move at a speed in accordance with values for currents output from main controller 52 to electromagnetic proportional control valves 61A and 61B.

Though a construction in which hydraulic pump 56 has main pump 56A supplying a hydraulic oil to work implement 104 and pilot pump 56B supplying an oil to electromagnetic proportional control valves 61A and 61B has been described above by way of example, limitation thereto is not intended. For example, a hydraulic pump supplying a hydraulic oil to work implement 104 and a hydraulic pump supplying an oil to electromagnetic proportional control valves 61A and 61B may be implemented as the same hydraulic pump (a single hydraulic pump). In this case, a flow of an oil delivered from this hydraulic pump should be branched before reaching work implement 104 so that the oil is supplied to electromagnetic proportional control valves 61A and 61B with a pressure of the branched oil being reduced.

<C. Functional Configuration of Controller>

Figure 4:
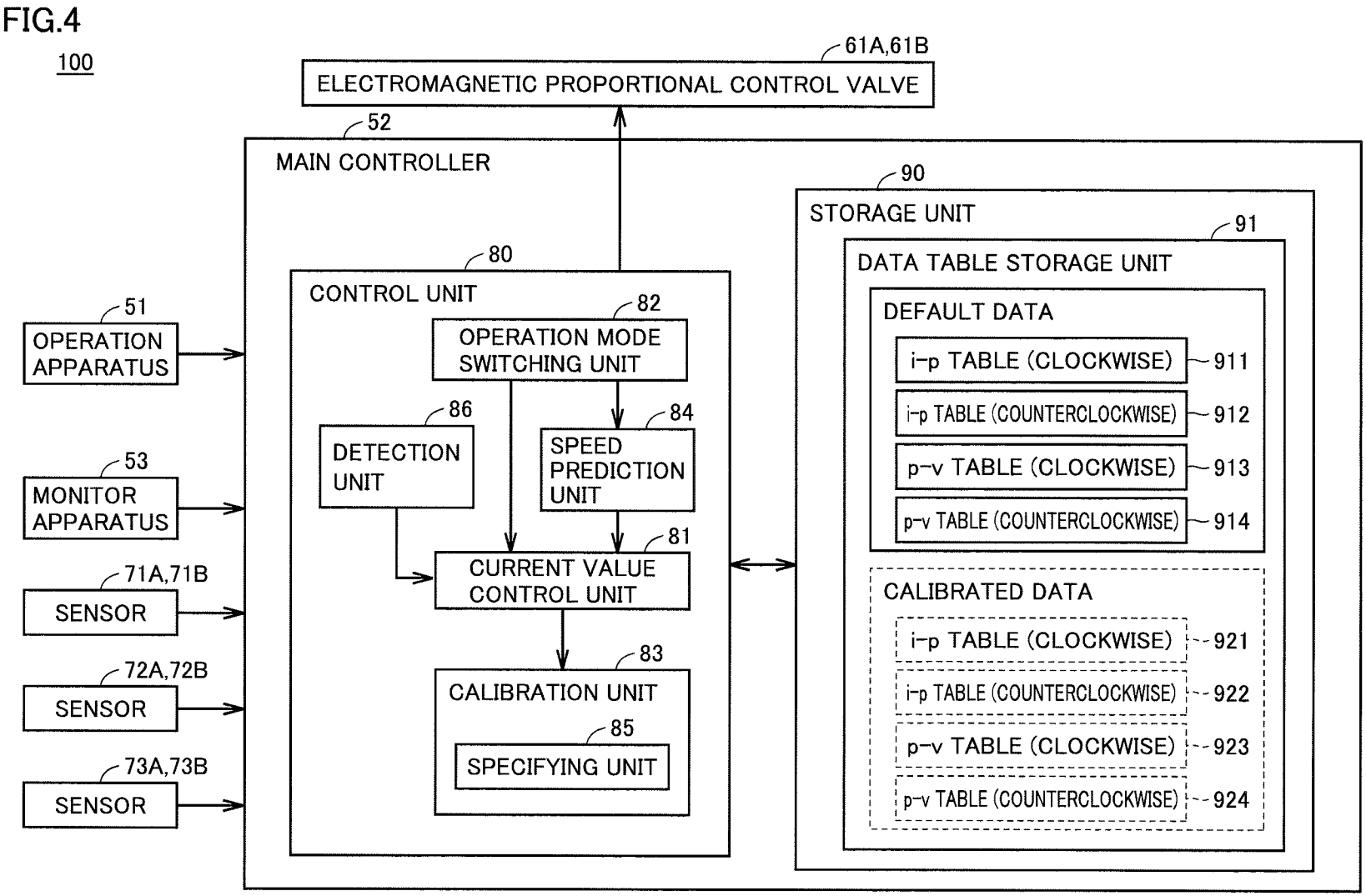
FIG. 4 is a block diagram showing a functional configuration of the work vehicle.

FIG. 4 is a block diagram showing a functional configuration of work vehicle 100.

As shown in FIG. 4, work vehicle 100 includes operation apparatus 51, main controller 52, monitor apparatus 53, electromagnetic proportional control valves 61A and 61B, sensors 71A and 71B, sensors 72A and 72B, and sensors 73A and 73B.

Main controller 52 includes a control unit 80 and a storage unit 90. Control unit 80 includes a current value control unit 81, an operation mode switching unit 82, a calibration unit 83, a speed prediction unit 84, and a detection unit 86. Calibration unit 83 includes a specifying unit 85.

Detection unit 86 detects bucket 107 reaching a horizontal state based on an output from at least one of sensors 73A and 73B. Detection unit 86 notifies current value control unit 81 of a result of detection.

Current value control unit 81 controls value for currents (command currents) output to electromagnetic proportional control valves 61A and 61B. Current value control unit 81 controls a current value in any of two operation modes (a normal mode and a calibration mode) which will be described later.

Storage unit 90 stores an operating system and various types of data. Storage unit 90 includes a data storage unit 91. Data storage unit 91 stores an i-p table 911, an i-p table 912, a p-v table 913, and a p-v table 914.

I-p table 911 defines relation between a value (i) for a current output from main controller 52 to electromagnetic proportional control valve 61A and a pilot pressure (p) assumed to be generated by electromagnetic proportional control valve 61A at the time when a current having the value is input to electromagnetic proportional control valve 61A.

I-p table 912 defines relation between a value (i) for a current output from main controller 52 to electromagnetic proportional control valve 61B and a pilot pressure (p) assumed to be generated by electromagnetic proportional control valve 61B at the time when a current having the value is input to electromagnetic proportional control valve 61B.

P-v table 913 defines relation between a pilot pressure (p) output from electromagnetic proportional control valve 61A to main valve 62A and an operation speed (v) of tilt cylinder 13A assumed at the time when the pilot pressure is applied to spool 621 of main valve 62A.

P-v table 914 defines relation between a pilot pressure (p) output from electromagnetic proportional control valve 61B to main valve 62B and an operation speed (v) of tilt cylinder 13B assumed at the time when the pilot pressure is applied to spool 621 of main valve 62B.

I-p table 911 and p-v table 913 are used when an operation to pivot bucket 107 clockwise is performed onto operation apparatus 51. I-p table 912 and p-v table 914 are used when an operation to pivot bucket 107 counterclockwise is performed onto operation apparatus 51.

I-p table 911, i-p table 912, p-v table 913, and p-v table 914 are used for predicting an operation speed of bucket 107 in a tilting operation (hereinafter also referred to as a "speed of the tilting operation"). Such data is used for automatic stop control (which may also hereinafter be referred to as "predictive control"). Overview of automatic stop control for a tilting operation will be described below.

Main controller 52 constantly calculates a distance between a design surface and cutting edge 1071*a* and a speed and an orientation of cutting edge 1071*a*. Main controller 52 calculates a speed allowable in accordance with a distance from the design surface by calculating (predicting) a speed generated at cutting edge 1071*a* based on an amount of operation of operation lever 51*a*. When main controller 52 determines that intervention control is necessary, main controller 52 geometrically makes conversion into a target speed of tilt cylinders 13A and 13B such that cutting edge 1071*a* is at an allowable speed, and controls a current value for electromagnetic proportional control valves 61A and 61B for which intervention control is determined to be necessary. Thus, main controller 52 brakes a tilting operation of the bucket and finally stops cutting edge 1071*a* at the design surface.

I-p table 911 and p-v table 913 are used in calculation of a speed of a clockwise operation of bucket 107 (specifically, cutting edge 1071*a*). Overview of calculation of a speed of a clockwise operation will be described below.

As operation lever 51*a* is operated, a current having a value (I) in accordance with an amount of operation of operation lever 51*a* is input from operation detector 51*b* to main controller 52. In this case, main controller 52 determines a value (i) for the current output to electromagnetic proportional control valve 61A based on the current value input from operation detector 51*b*.

Main controller 52 specifies in i-p table 911 a pilot pressure (p) brought in correspondence with the determined current value (i). Main controller 52 specifies an operation speed of tilt cylinder 13A brought in correspondence with the specified pilot pressure (9) in p-v table 913.

Thus, main controller 52 calculates (predicts) a speed of a clockwise operation of bucket 107 by using i-p table 911 and p-v table 913.

I-p table 912 and p-v table 914 are used for calculating a speed of a counterclockwise operation of bucket 107 (specifically, cutting edge 1071*a*). Overview of calculation of a speed of a counterclockwise operation will be described.

As operation lever 51*a* is operated, a current having a value (I) in accordance with an amount of operation of operation lever 51*a* is input from operation detector 51*b* to main controller 52. In this case, main controller 52 determines a value (i) for a current output to electromagnetic proportional control valve 61B based on the current value input from operation detector 51*b*.

Main controller 52 specifies in i-p table 912 a pilot pressure (p) brought in correspondence with the determined current value (i). Main controller 52 specifies an operation speed of tilt cylinder 13B brought in correspondence with the specified pilot pressure (9) in p-v table 914.

Thus, main controller 52 calculates (predicts) a speed of a counterclockwise operation of bucket 107 by using i-p table 912 and p-v table 914.

Speed prediction unit 84 calculates (predicts) speeds of clockwise and counterclockwise operations of bucket 107. Current value control unit 81 controls current values output to electromagnetic proportional control valves 61A and 61B (hereinafter also referred to as a "command current value") as described above, based on the operation speed obtained through calculation.

I-p table 911, i-p table 912, p-v table 913, and p-v table 914 are also referred to as "default data" below.

Operation mode switching unit 82 switches an operation mode to any of a normal operation mode in which an excavation operation is performed (hereinafter also referred to as a "normal mode") and an operation mode for calibrating default data (hereinafter also referred to as a "calibration mode") in accordance with a setting instruction to monitor apparatus 53 from an operator. When the operation mode is set to the normal mode, main controller 52 performs an automatic control function using default data. When the operation mode is set to the calibration mode, calibration unit 83 calibrates default data in response to an operation by an operator to thereby generate calibrated data.

Specifically, calibration unit 83 calibrates i-p table 911 and generates an i-p table 921. Similarly, calibration unit 83 calibrates each of i-p table 912, p-v table 913, and p-v table 914, and generates an i-p table 922, a p-v table 923, and a p-v table 924 corresponding thereto, respectively.

Some of reasons for calibration as above are as below.

There is an individual difference between electromagnetic proportional control valves 61A and 61B. Therefore, even when electromagnetic proportional control valves of the same type are mounted on a plurality of work vehicles of the same type and currents having the same value are input thereto, outputs are not exactly the same among the work vehicles. There is an individual difference also between sensors 72A and 72B.

Since there is a mechanical tolerance and an individual difference in spring also between main valves 62A and 62B, there is also an individual difference in amount of stroke of spool 621. Even when an amount of stroke of spool 621 is the same between the main valves, a hydraulic oil at the same flow rate is not necessarily supplied to tilt cylinders 13A and 13B due to the individual difference in notches in an opening portion for feeding a hydraulic oil and a difference in pressure loss caused by a difference in piping. Even when a hydraulic oil at the same flow rate per unit time is supplied to tilt cylinders 13A and 13B of each work vehicle, operation speeds of tilt cylinders 13A and 13B are not exactly the same among work vehicles of the same type due to an individual difference between tilt cylinders 13A and 13B.

From such a point of view, in order to adapt i-p table 911, i-p table 912, p-v table 913, and p-v table 914 to characteristics of work vehicle 100, i-p table 911, i-p table 912, p-v table 913, and p-v table 914 are subjected to calibration processing.

The reason why a table for a clockwise direction and a table for a counterclockwise direction are prepared includes an individual difference between tilt cylinders 13A and 13B. Furthermore, a path of piping from main valve 62A to tilt cylinder 13A is different from a path of piping from main valve 62B to tilt cylinder 13B. Therefore, pressure loss caused until a hydraulic oil supplied from main valve 62A reaches tilt cylinder 13A is not the same as pressure loss caused until a hydraulic oil supplied from main valve 62B reaches tilt cylinder 13B. In consideration also of such a difference in pressure loss, a table for a clockwise direction and a table for a counterclockwise direction are prepared.

Specifying unit 85 of calibration unit 83 specifies values for command currents from main controller 52 to electromagnetic proportional control valves 61A and 61B at the time when bucket 107 starts a tilting operation. A specific example of processing in the specifying unit will be described later.

A specific method of calibration of each table will be described below for each of calibration of an i-p table and calibration of a p-v table.

In the present example, i-p tables 911 and 912 and p-v tables 913 and 914 represent examples of "data for predicting an operation speed of a work implement." I-p tables 911 and 912 and p-v tables 913 and 914 also represent examples of data on a speed of a tilting operation. The clockwise direction and the counterclockwise direction represent examples of the "first direction" and the "second direction," respectively. The normal mode and the calibration mode represent examples of the "first operation mode" and the "second operation mode," respectively. Main controller 52, tilt cylinder 13A, tilt cylinder 13B, electromagnetic proportional control valve 61A, and electromagnetic proportional control valve 61B represent examples of the "controller," the "first cylinder," the "second cylinder," the "first electromagnetic proportional control valve," and the "second electromagnetic proportional control valve," respectively. The pilot pump represents one example of the "pilot oil pressure source."

<D. Calibration of Table>

Since an i-p table is specific to a main body itself of work vehicle 100, it should basically be calibrated only once. Since the i-p table affects an operation of work vehicle 100 more greatly than the p-v table, only a serviceperson and a specific manager should preferably be provided with authorization for calibration. The p-v table should be calibrated each time a bucket is replaced with another bucket.

From such a point of view, in work vehicle 100, an i-p table and a p-v table can separately be calibrated. In particular, prescribed authorization is required for calibration of an i-p table. For example, a serviceperson enters a specific code such as a password into monitor apparatus 53 in order to show an operation menu for calibration of an i-p table on monitor apparatus 53. Thereafter, the serviceperson calibrates the i-p table by performing a prescribed input operation in the operation menu.

In calibration of the i-p table, it is not necessary to perform a tilting operation. In calibration of a p-v table, bucket 107 should actually perform a tilting operation.

Though a configuration in which main controller 52 stores data in a form of a table as described as i-p tables 911 and 912 and p-v tables 913 and 914 is described by way of example in the present embodiment, limitation thereto is not intended. For example, the main controller may store as a function, relation between values (i) for currents output to electromagnetic proportional control valves 61A and 61B and pilot pressures (p) assumed to be generated by electromagnetic proportional control valves 61A and 61B at the time when the currents having the current values are input to electromagnetic proportional control valves 61A and 61B. Similarly, main controller 52 may store as a function, relation between pilot pressures (p) output from electromagnetic proportional control valves 61A and 61B to main valves 62A and 62B and operation speeds (v) of tilt cylinders 13A and 13B assumed at the time when the pilot pressures are applied to spools 621 of main valves 62A and 62B.

(d1. Calibration of i-p Table)

Calibration of i-p table 911 of i-p table 911 and i-p table 912 will be described below. Since calibration of i-p table 912 is also the same as calibration of i-p table 911, description will not be repeated below.

Figure 5:
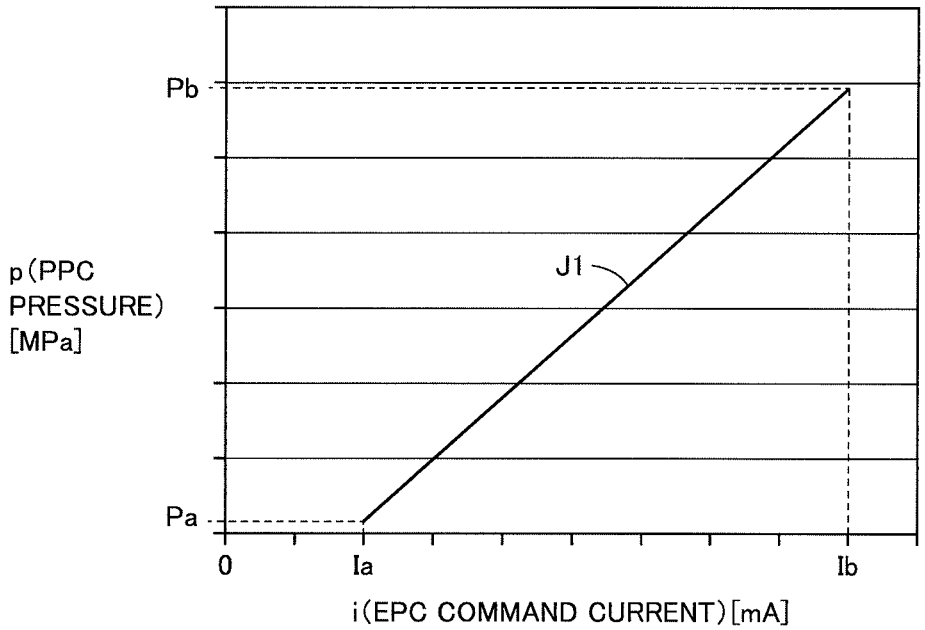
FIG. 5 is a diagram for illustrating an i-p table before calibration.

FIG. 5 is a diagram for illustrating i-p table 911 before calibration.

As shown in FIG. 5, data (discrete values) in i-p table 911 is plotted in a graph for the sake of convenience of description and i-p table 911 is expressed as a line segment J1.

In i-p table 911, relation between a value i for a command current and a pilot pressure (a ppc pressure) is defined within a range from Ia to Ib. When a value i for the command current is set to Ia, a value for the pilot pressure is set to Pa. I-p table 911 is set such that a value for a pilot pressure is higher with increase in current value i. When a value i for the command current is set to Ib, a value for the pilot pressure is set to Pb.

Figure 6:
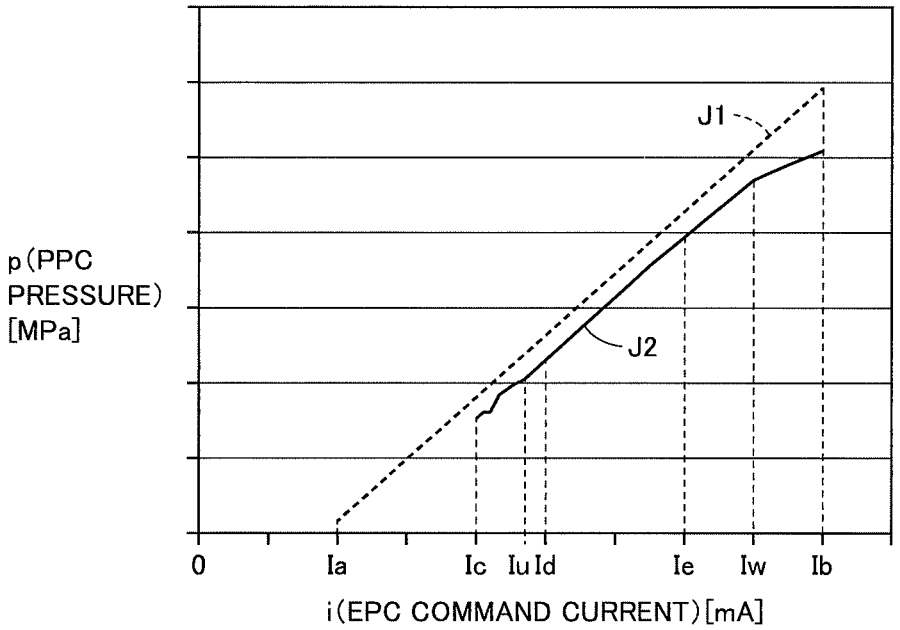
FIG. 6 is a diagram showing an actually measured value of a pilot pressure output at the time when a value i for a command current is actually increased.

FIG. 6 is a diagram showing an actually measured value of a pilot pressure output when a value i for a command current is actually increased. A value i for the command current is measured with sensor 71A. A pilot pressure is measured with sensor 72A.

As shown in FIG. 6, a pilot pressure measured with sensor 72A at the time when a value i for the command current output to electromagnetic proportional control valve 61A increases from Ic to Ib is expressed as a line segment J2. Within a range of a current value i from Iu to Iw, a pilot pressure increases at a substantially constant rate with increase in value i for the command current. Iu is a value not smaller than Ic and not greater than Id. Iw is a value not smaller than Id and not greater than Ib.

When a current value i exceeds Iw, a rate of increase in pilot pressure with respect to a current value i lowers. Ie is a value not smaller than Id and not greater than Iw. Id, Ie, and Ib are fixed values. In a range of a current value i from Ic to Iu (<Id), a pilot pressure may not increase in spite of increase in current value i.

In view of characteristics as above, calibration unit 83 calibrates i-p table 911 with a pilot pressure at the time when a current value i is set to Id, Ie, or Ib.

Figure 7:
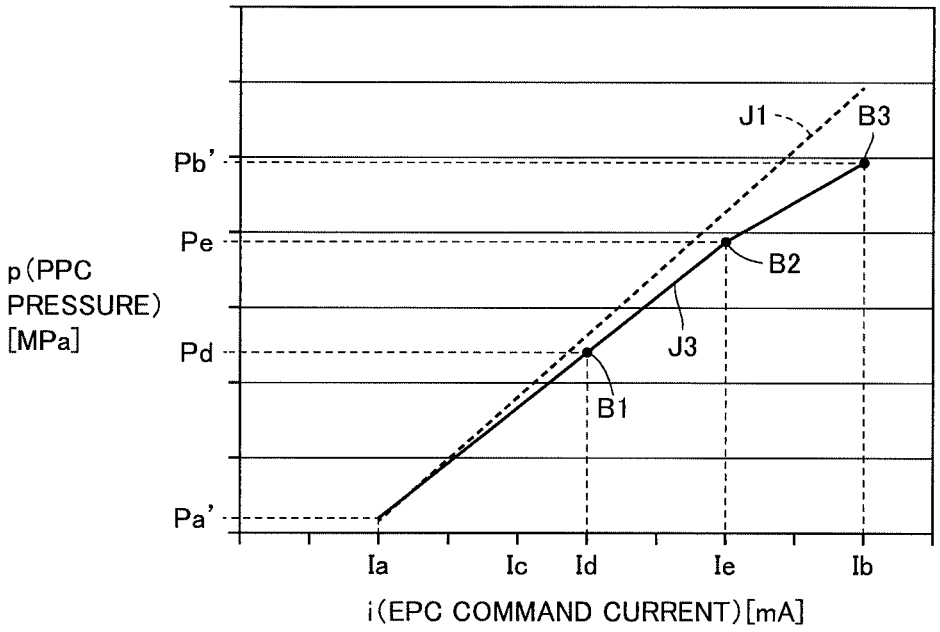
FIG. 7 is a diagram for illustrating a calibrated i-p table.

FIG. 7 is a diagram for illustrating a calibrated i-p table.

As shown in FIG. 7, data (discrete values) in calibrated i-p table 921 is plotted in a graph for the sake of convenience of description and i-p table 921 is expressed as a line segment J3.

Calibration unit 83 performs linear interpolation by using a coordinate point B1 at which a current value is at Id and a pilot pressure is at Pd and a coordinate point B2 where a current value is at Ie and a pilot pressure is at Pe. Calibration unit 83 performs linear interpolation by using coordinate point B2 and a coordinate point B3 where a current value is at Ib and a pilot pressure is at Pb'. Calibration unit 83 obtains calibrated i-p table 921 in a range of a current value i from Id to Ib through such data processing.

Calibration in a region where a current value i is not greater than Id will now be described.

Calibration unit 83 calibrates i-p table 911 such that a rate of change in pilot pressure with respect to a current value i in a region where a current value i is smaller than Id (Ia<i<Id) is the same as a rate of change in pilot pressure with respect to a current value between Id and Ie. Therefore, in the region where a current value i is smaller than Id, a straight line connecting coordinate point B1 and coordinate point B2 to each other is extended.

Through the processing above, calibration unit 83 obtains calibrated i-p table 921 in which inclination of the graph varies at coordinate point B2 where a current value i is at Ie in the region where a current value i is not smaller than Ia and not greater than Ib.

Id is a value greater than a value for a command current at the time when bucket 107 starts a clockwise tilting operation.

(d2. Calibration of p-v Table)

Calibration of p-v tables 913 and 914 will now be described. P-v tables 913 and 914 are calibrated after i-p tables 911 and 912 are calibrated. As described above, in calibrating p-v tables 913 and 914, bucket 107 should perform a tilting operation.

(1) p-v Table Before Calibration

In p-v table 913, a pilot pressure and an operation speed of tilt cylinder 13A are brought in correspondence with each other. Pilot pressures P1, P2, P3, . . . P10 are brought in correspondence with operation speeds V1, V2, V3, . . . V10, respectively below. For the sake of convenience of description, P1, P2, P3, . . . P10 are also referred to as a "pilot pressure No. 1," a "pilot pressure No. 2," a "pilot pressure No. 3," . . . a "pilot pressure No. 10," respectively. V1, V2, V3, . . . V10 are also referred to as an "operation speed No. 1," an "operation speed No. 2," an "operation speed No. 3," . . . an "operation speed No. 10," respectively. Though the number of pieces of data in p-v table 913 is set to 10, this is by way of example and the number is not limited to 10. An operation speed of tilt cylinder 13A is simply also referred to as a "cylinder speed V."

Figure 8:
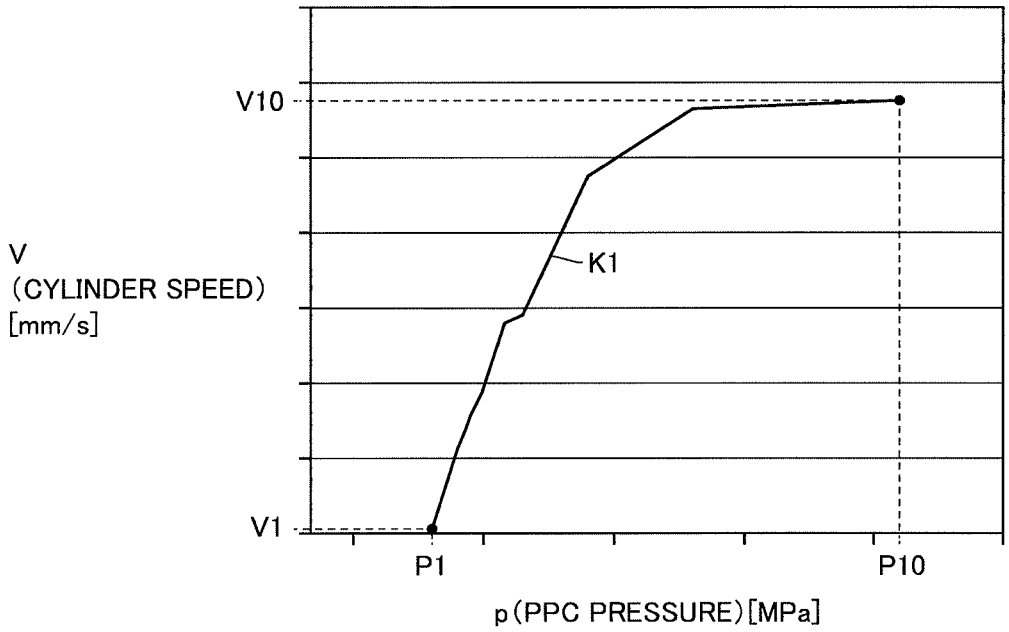
FIG. 8 is a diagram for illustrating a p-v table before calibration.

FIG. 8 is a diagram for illustrating p-v table 913 before calibration.

As shown in FIG. 8, data (discrete values) in p-v table 913 is plotted in a graph for the sake of convenience of description and p-v table 913 is expressed as a line segment K1. When a pilot pressure is set to P1, a value for an operation speed of tilt cylinder 13A is set to V1. When a pilot pressure is set to P10, a value for an operation speed of tilt cylinder 13A is set to V10.

P-v table 913 is defined such that an operation speed of tilt cylinder 13A is higher with increase in pilot pressure. In a region where a pilot pressure is close to P10, a rate of increase in operation speed with respect to increase in pilot pressure is lower than in other regions.

Since p-v table 914 is also configured similarly to p-v table 913, description thereof will not be repeated.

(2) Detection of Point of Start of Movement

In calibration of p-v table 913, a pilot pressure (an actually measured value) at a point where bucket 107 starts a clockwise tilting operation (hereinafter also referred to as a "point of start of movement") is necessary. The point of start of movement is defined by a value i for the command current at the time when the tilting operation is started and a pilot pressure measured with sensor 72A at the time when the command current is output to electromagnetic proportional control valve 61A.

A plurality of work vehicles are different from one another in point of start of movement. Even in a single work vehicle 100, a pilot pressure at the point of start of movement is not necessarily always constant. Therefore, in calibration of p-v table 913, a position of the point of start of movement should be specified. Specifying unit 85 in calibration unit 83 specifies the point of start of movement.

Similarly, in calibration of p-v table 914, a pilot pressure (an actually measured value) at the point of start of movement where bucket 107 starts a counterclockwise tilting operation is required.

After bucket 107 is set to the horizontal state, processing for calibrating p-v table 913 is started. Preferably, after cutting edge 1071*a* of bucket 107 and pivot axis AX (see FIG. 1) are set to the horizontal state, processing for calibrating p-v table 913 is started. Current value control unit 81 increases a value for a command current output to electromagnetic proportional control valve 61A stepwise from a prescribed value. With such increase in current value, bucket 107 is inclined clockwise from the horizontal state.

Similarly, after bucket 107 is set to the horizontal state, processing for calibrating p-v table 914 is started. Preferably, after cutting edge 1071*a* of bucket 107 and pivot axis AX (see FIG. 1) are set to the horizontal state, processing for calibrating p-v table 914 is started. Current value control unit 81 increases a value for a command current output to electromagnetic proportional control valve 61B stepwise from a prescribed value. With such increase in current value, bucket 107 is inclined counterclockwise from the horizontal state.

The reason why p-v tables 913 and 914 are calibrated after bucket 107 is set to the horizontal state is as follows. When a command current is fed with bucket 107 being inclined, bucket 107 may tilt of itself due to gravity. When bucket 107 performs a tilting operation in the normal mode, a tilt angle should finely be adjusted. Even in an aspect requiring fine adjustment, automatic stop control should accurately be carried out. Therefore, relation between pilot pressures and operation speeds of tilt cylinders 13A and 13B at the time when there is no influence by gravity and a bucket is operating slightly fast is desirably obtained. Thus, main controller 52 calibrates p-v tables 913 and 914 after bucket 107 is set to the horizontal state.

Figure 9:
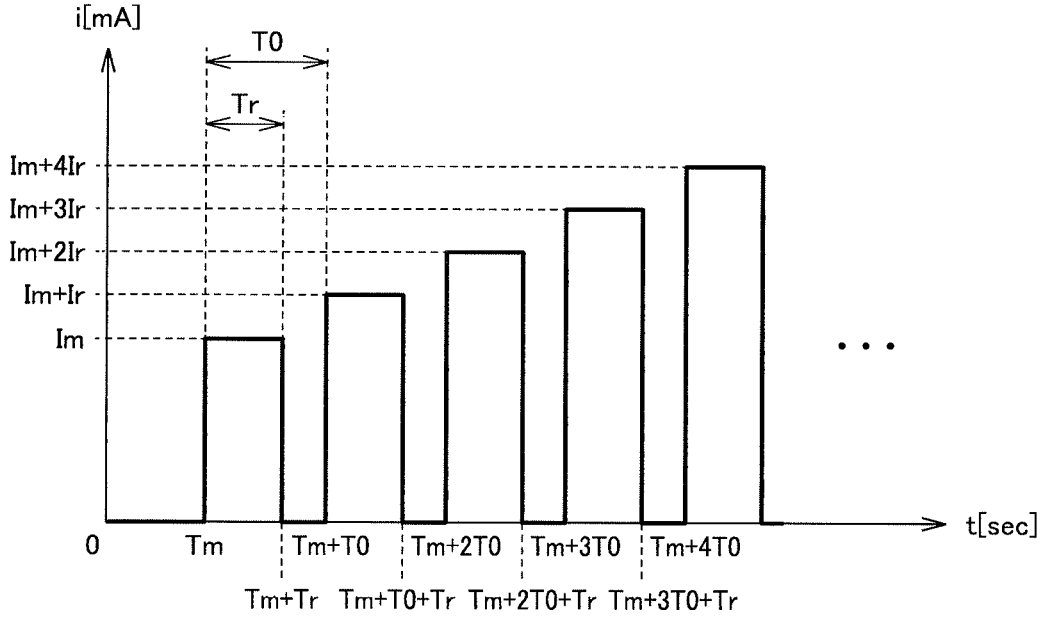
FIG. 9 is a diagram for illustrating how to increase a value for a command current output to an electromagnetic proportional control valve.

FIG. 9 is a diagram for illustrating how to increase a value for a command current output to electromagnetic proportional control valve 61A. As shown in FIG. 9, current value control unit 81 increases a value for a command current output to electromagnetic proportional control valve 61A stepwise from a prescribed value Im.

Current value control unit 81 increases stepwise a value for a command current output to electromagnetic proportional control valve 61A by repeating processing for temporarily lowering a value for a command current output to electromagnetic proportional control valve 61A and thereafter outputting a command current having a value greater than the value before lowering to electromagnetic proportional control valve 61A. Typically, current value control unit 81 repeats processing for temporarily lowering a value for a command current output to electromagnetic proportional control valve 61A to a predetermined value and thereafter outputting a command current having a value greater than the value before lowering to electromagnetic proportional control valve 61A. Preferably, the predetermined value is zero as shown in FIG. 9.

Description in accordance with FIG. 9 will be given below. Current value control unit 81 outputs a command current having value Im to electromagnetic proportional control valve 61A during a period from a time Tm to a time Tm+Tr. Tr represents a prescribed time period. Thereafter, current value control unit 81 once sets a value for the command current to zero. Then, current value control unit 81 outputs a command current having a value Im+Ir to electromagnetic proportional control valve 61A during a period from a time Tm+T0 to a time Tm+T0+Tr. T0 represents a prescribed period.

Furthermore, current value control unit 81 once sets a value for the command current to zero. Then, current value control unit 81 outputs a command current having a value Im+2Ir to electromagnetic proportional control valve 61A during a period from a time Tm+2T0 to a time Tm+2T0+Tr.

Thus, current value control unit 81 periodically carries out control to set a current value to zero and to increase the current value in increments of Ir.

Sensor 73A detects an operation speed of tilt cylinder 13A at the time when a current value is increased stepwise and notifies main controller 52 of the operation speed. Specifying unit 85 of main controller 52 calculates an average operation speed of tilt cylinder 13A within a prescribed time period. Typically, specifying unit 85 calculates an average operation speed of tilt cylinder 13A for Tr seconds when the command current has values of Im, Im+Ir, Im+2Ir, Im+3Ir, and Im+4Ir.

Specifying unit 85 specifies a value for a command current at the time when an average operation speed of tilt cylinder 13A exceeds a threshold value Thv (mm/sec). Specifying unit 85 sets a current value lower by Ir than the specified current value as a current value at the time when the tilting operation starts. For example, when specifying unit 85 determines that the average operation speed exceeds threshold value Thv (mm/sec) at the time when the current value is at Im+4Ir, it sets Im+3Ir as the current value at the time when the tilting operation starts.

As set forth above, when a current value is increased stepwise by current value control unit 81, specifying unit 85 specifies a value for a command current at the time when bucket 107 starts a tilting operation based on a result of detection by sensor 73A.

Since how a value for a command current output to electromagnetic proportional control valve 61B is increased is also the same, description will not be repeated here.

In the example above, a current value lower by Ir than a specified current value is set as a current value at the time when the tilting operation starts, however, limitation thereto is not intended. For example, specifying unit 85 may set a value smaller than a specified current value and not smaller than a current value smaller by Ir than the current value, as a current value at the time when the tilting operation starts. For example, when specifying unit 85 determines that the average operation speed exceeds threshold value Thy (mm/sec) with the current value being set to Im+4Ir, it may set a value smaller than Im+4Ir and not smaller than Im+3Ir as a current value at the time when the tilting operation starts.

The reason why a value for a command current is once lowered to a predetermined value (typically zero) in stepwise increase in value for a command current as above is as follows.

Theoretically, when a value for a command current is increased in increments of Ir, a pilot pressure output from electromagnetic proportional control valve 61A must also increase in increments of current value Ir. Actually, however, it is not the case. The reason is because a spool in electromagnetic proportional control valve 61A remains stopped without static frictional force being overcome even when a current value is increased by Ir.

When a command current value is once lowered, for example, to zero, a difference between a current value (zero) at the time when the command current value is lowered and a value for a command current output to electromagnetic proportional control valve 61A is greater. For example, a difference in current value is not Ir but Im+nIr (n being a natural number not smaller than 1). Therefore, since the spool in electromagnetic proportional control valve 61A overcomes static frictional force, the spool can be prevented from remaining stopped in spite of increase in current value.

Therefore, by increasing a value for a command current as shown in FIG. 9, the point of start of movement can correctly be detected. A value for a command current at the point of start of movement is denoted below as Is.

Calibration unit 83 specifies a pilot pressure corresponding to current value Is in i-p table 921. A value for this pilot pressure is denoted as Ps.

Through the processing above, calibration unit 83 can obtain pilot pressure Ps at the point of start of movement.

(3) Detection of Pilot Pressure and Operation Speed of Tilt Cylinder at the Time When Current Value Iz is Set Main controller 52 measures with sensor 72A and sensor 73A, a pilot pressure output from electromagnetic proportional control valve 61A and an operation speed of tilt cylinder 13A at the time when a value for a command current is set to Iz. Main controller 52 similarly measures with sensor 72B and sensor 73B, a pilot pressure output from electromagnetic proportional control valve 61B and an operation speed of tilt cylinder 13B at the time when a value for a command current is set to Iz.

Current value Iz is a value, for example, as large as current value Ie. When current value Ie is set, bucket 107 is tilted at a speed close to a highest speed which can be attained by bucket 107.

In calibration of p-v table 913, after bucket 107 is tilted counterclockwise to a maximum angle θmax, main controller 52 continues to output a command current having a value Iz to electromagnetic proportional control valve 61A on the condition that an operation onto operation lever 51*a* is performed by an operator. Consequently, bucket 107 starts clockwise tilting and is tilted counterclockwise to maximum angle θmax after it goes through the horizontal state.

In calibration of p-v table 914, after bucket 107 is tilted clockwise to maximum angle θmax, main controller 52 continues to output a command current having value Iz to electromagnetic proportional control valve 61B on the condition that an operation onto operation lever 51*a* is performed by an operator. Consequently, bucket 107 starts counterclockwise tilting and is tilted clockwise to maximum angle θmax after it goes through the horizontal state.

The reason why command currents having value Iz are output to electromagnetic proportional control valves 61A and 61B on the condition that an operation of operation lever 51*a* is performed by an operator as above is as follows.

In calibration of a p-v table, tilt cylinders 13A and 13B should be operated. Since operation apparatus 51 is an electronic apparatus, tilt cylinders 13A and 13B can be operated by pseudo output of a command current (signal) from main controller 52 without an operation of operation lever 51*a*.

It is not, however, not preferable from a point of view of operability that bucket 107 automatically operates while an operator does not intend to have bucket 107 perform a tilting operation. In particular, when current value Iz is as large as Ie, bucket 107 is tilted at a speed close to a highest speed as described above. Therefore, it is preferable from a point of view of operability that bucket 107 performs a tilting operation while an operator is clearly aware of an operation to have bucket 107 perform a tilting operation.

Therefore, command currents having value Iz are output to electromagnetic proportional control valves 61A and 61B on the condition that an operation of operation lever 51*a* is performed by an operator. In calibration of p-v tables 913 and 914, when main controller 52 monitors a current value (I) in accordance with an amount of operation of operation lever 51*a* and senses a current value (I) not smaller than a prescribed value, it outputs command currents having value Iz to electromagnetic proportional control valves 61A and 61B.

In detection of a point of start of movement, main controller 52 sets a speed of the tilting operation to be very low. Therefore, since operability is hardly affected even though bucket 107 automatically operates, main controller 52 does not monitor a current value (I). From such a point of view, in detection of a point of start of movement, bucket 107 is tilted not on the condition that an operation of operation lever 51*a* is performed by an operator. A point of start of movement, however, may also be detected on the condition that an operation of operation lever 51*a* is performed by an operator.

The reason for measuring a pilot pressure and an operation speed of tilt cylinder 13A (a highest speed of the operation speed) at the time when a current value is set to Iz after bucket 107 is tilted by maximum angle θmax as described above is as follows.

Unless stroke lengths of tilt cylinders 13A and 13B are ensured to some extent, bucket 107 reaches the stroke end without reaching a highest speed even though command currents having large values are output to electromagnetic proportional control valves 61A and 61B. Therefore, preferably, a pilot pressure and an operation speed of tilt cylinders 13A and 13B at the time when a current value is set to Iz are measured with a stroke length being ensured.

Since it is a highest speed that is desirably measured, influence by gravity does not give rise to a problem. A situation that tilting of bucket 107 should automatically be stopped when a value for a command current is set to Iz is that an operator erroneously performs an operation to increase a cylinder speed.

For the reason above, after bucket 107 is tilted by maximum angle θmax, a pilot pressure and an operation speed of tilt cylinder 13A at the time when a current value is set to Iz are measured.

In the following, a pilot pressure and an operation speed (a highest speed) of tilt cylinder 13A measured at the time when a current value is set to Iz are denoted as Pz and Vz, respectively.

In the present example, current value Is and current value Iz represent examples of the "first current value" and the "second current value," respectively.

(4) Calculation of Calibration Ratio

A method of calculating a calibration ratio Rp used in calibration of a pilot pressure (p) in p-v table 913 and a calibration ratio Rv used in calibration of an operation speed (v) in p-v table 913 will be described. Since a calibration ratio is calculated with the same technique also in p-v table 914, description will not be repeated here.

FIG. 10 is a diagram for illustrating a technique for calculating calibration ratios Rp and Rv. A method of calculating calibration ratio Rp will initially be described.

As shown in FIG. 10, calibration unit 83 calculates a difference (Pz−Ps) between pilot pressure Pz at the time when a value for a command current is set to Iz and pilot pressure Ps at the time when a current value is at Is at the point of start of movement.

Calibration unit 83 further calculates a difference (P8−P1) in p-v table 913 before calibration. The reason why P1 is subtracted from P8 in calculation of the difference is as follows. Pilot pressure P1 is used because it is a pilot pressure at the point of start of movement. In a region of a pilot pressure higher than pilot pressure P8, from a point of view of approximation to a shape of p-v table 913 before calibration, a pilot pressure is not calibrated.

Calibration unit 83 finds calibration ratio Rp (=(Pz−Ps)/(P8−P1)) by dividing the difference between Pz and Ps by the difference in p-v table 913 before calibration.

A method of calculating calibration ratio Rv will now be described.

Calibration unit 83 calculates a difference (Vz−Vf) between operation speed Vz at the time when a value for a command current is at Iz and a predetermined speed Vf. Vf can be, for example, a value as large as V1.

Calibration unit 83 further calculates a difference (V8−V1) in p-v table 913 before calibration. Calibration unit 83 finds calibration ratio Rv (=(Vz−Vf/(V8−V1)) by dividing the difference between Vz and Vf by the difference in p-v table 913 before calibration.

As set forth above, calibration unit 83 calculates calibration ratio Rp by dividing the difference (Pz−Ps) between pilot pressure Pz measured at the time when a current having value Iz is output and pilot pressure Ps specified by specifying unit 85 by the difference (P8−P1) between two prescribed pilot pressures (P8 and P1) in p-v table 913. Calibration unit 83 calculates calibration ratio Rv by dividing the difference (Vz−Vf) between operation speed Vz of tilt cylinder 13A measured at the time when a current having value Iz is output and predetermined speed Vf by the difference (V8−V1) between two operation speeds (V8 and V1) associated with tilt cylinder 13A brought in correspondence with the two prescribed pilot pressures (P8 and P1) in p-v table 913.

In the present example, calibration ratio Rp and calibration ratio Rv represent examples of the "first calibration ratio" and the "second calibration ratio," respectively.

(5) Generation of Calibrated p-v Table

A method of generating p-v table 923 from p-v table 913 by using calibration ratios Rp and Rv will now be described. Since a method of generating p-v table 924 from p-v table 914 is also the same as the method of generating p-v table 923 from p-v table 913, description will not be repeated here.

FIG. 11 is a diagram for illustrating data tables 951 and 952 obtained by calculation processing. FIG. 11(A) is a diagram showing data table 951 after a pilot pressure is subjected to offset processing in p-v table 913 before calibration. FIG. 11(B) is a diagram showing data table 952 obtained by using data table 951 shown in FIG. 11(A).

As shown in FIG. 11(A), calibration unit 83 subtracts a difference (P1−Ps) between P1 and Ps from each of pilot pressures Nos. 2 to 8 in p-v table 913.

As shown in FIG. 11(B), calibration unit 83 obtains data table 952 by calculating a difference between vertically adjacent pieces of data in connection with a pilot pressure and an operation speed in data table 951.

This processing will be described below by way of example with reference to data No. 1 and data No. 2 in data table 951. Calibration unit 83 subtracts pilot pressure No. 1 (Ps) from pilot pressure No. 2 (P2−(P1−Ps)). Thus, calibration unit 83 obtains a value for P2−P1. Calibration unit 83 further subtracts operation speed No. 1 (V1) from operation speed No. 2 (V2). Calibration unit 83 thus obtains a value for V2−V1.

FIG. 12 is a diagram showing calibrated data. FIG. 12(A) is a diagram showing calibrated differential data. FIG. 12(B) is a diagram showing calibrated p-v table 923.

As shown in FIG. 12(A), calibration unit 83 multiples each pilot pressure in FIG. 11(B) by calibration ratio Rp. Calibration unit 83 multiplies each operation speed in FIG. 11(B) by calibration ratio Rv. Calibration unit 83 thus obtains calibrated differential data 953.

As shown in FIG. 12(B), calibration unit 83 generates p-v table 923 by using Ps, V1, P9, and P10 in data table 951 shown in FIG. 11(A) and calibrated differential data 953 shown in FIG. 12(A).

Calibration unit 83 sets pilot pressure No. 1 and operation speed No. 1 to values the same as in data table 951 subjected to offset processing and shown in FIG. 11(A). Calibration unit 83 sets pilot pressures Nos. 9 and 10 to values the same as in data table 951. The calibration unit calibrates other data with calibrated differential data, which will be described below.

In order to find a calibrated ith (2≤i≤8) pilot pressure, calibration unit 83 performs processing for adding the sum from Dp1 to Dp(i−1) to Ps. By way of example, calibration unit 83 calculates a fifth calibrated pilot pressure (No. 5) as Ps+Dp1+Dp2+Dp3+Dp4. Since i is set to 5, Dp(i−1) is Dp4.

In order to find a calibrated jth (2≤j≤10) operation speed, calibration unit 83 further performs processing for adding the sum from Dv1 to Dv(j−1) to V1. By way of example, calibration unit 83 calculates a fifth (No. 5) calibrated operation speed as V1*s*+Dv1+Dv2+Dv3+Dv4. Since j is set to 5, Dv(j−1) is Dv4.

Through calculation processing above, calibration unit 83 obtains calibrated p-v table 923 from p-v table 913.

Figure 13:
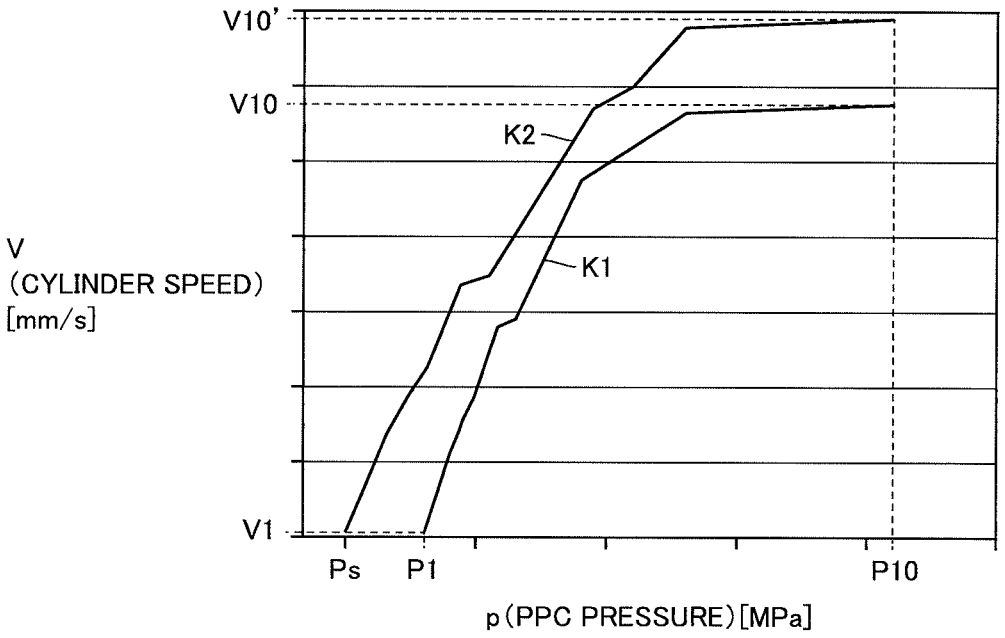
FIG. 13 is a diagram for illustrating a calibrated p-v table.

FIG. 13 is a diagram for illustrating calibrated p-v table 923.

As shown in FIG. 13, data (discrete values) in p-v table 923 shown in FIG. 12 (B) is plotted in a graph for the sake of convenience of description and p-v table 923 is expressed as a line segment K2. Line segment K1 shows p-v table 913 before calibration as shown also in FIG. 8. It can be seen in FIG. 13 that while line segment K2 maintains a shape the same as the shape of line segment K1, it has been calibrated.

As set forth above, calibration unit 83 adjusts a value for a current output to electromagnetic proportional control valve 61A after the horizontal state of bucket 107 is detected, and starts calibration of p-v table 913. Specifically, calibration unit 83 calibrates p-v table 913 based on pilot pressure Ps specified by specifying unit 85, predetermined speed Vf, as well as pilot pressure Pz and operation speed Vz of tilt cylinder 13A measured at the time when a current having value Iz greater than current value Is is output from main controller 52 to electromagnetic proportional control valve 61A.

In work vehicle 100, as described above, in calibration of p-v table 913, a pilot pressure at the time when a current value is at Is (the point of start of movement) and a pilot pressure and an operation speed of tilt cylinder 13A at the time when a current value is at Iz are made use of as actually measured values to be used for calibration. Thus, in work vehicle 100, p-v table 913 can be calibrated simply by obtaining actually measured values for two values Is and Iz for a command current.

Tilt cylinders 13A and 13B are shorter in stroke length than boom cylinder 10 and arm cylinder 11. Therefore, in an operation to extend a cylinder in one direction once, as compared with boom cylinder 10 and arm cylinder 11, it is more difficult to obtain actually measured values of many currents.

According to work vehicle 100, however, in calibration of p-v table 913, tilt cylinder 13A should be extended only twice. Specifically, a cylinder operation for moving bucket 107 and a cylinder operation for moving bucket 107 are only sufficient. Similarly, in calibration of p-v table 914, tilt cylinder 13B should be extended only twice.

As shown also in FIG. 13, p-v table 913 before calibration and calibrated p-v table 923 are close in shape to each other. Therefore, operational feeling felt by an operator does not greatly vary. Thus, according to work vehicle 100, p-v tables 913 and 914 can highly accurately be calibrated only with actually measured values of current value Is and current value Iz.

<E. User Interface>

A user interface shown on monitor apparatus 53 when p-v tables 913 and 914 are calibrated will be described. I-p tables 911 and 912 have already been calibrated.

Figure 14:
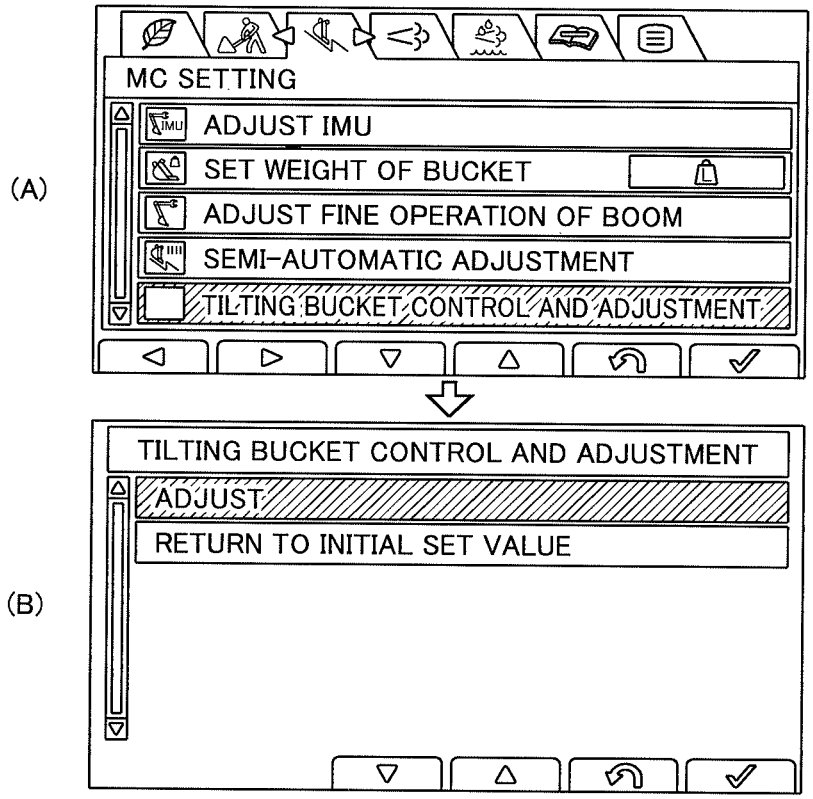
FIG. 14 is a diagram showing transition of a screen until transition to a mode for calibration of the i-p table and the p-v table.

FIG. 14 is a diagram showing transition of a screen until transition to a mode for calibration of p-v tables 913 and 914. As shown in FIG. 14, when an operator selects an item of tilting bucket control and adjustment (a state (A)), the monitor apparatus shows an adjustment execution button for calibrating p-v tables 913 and 914. When the adjustment execution button is selected (a state (B)), main controller 52 makes transition of the operation mode from the normal mode to the calibration mode in which calibration of the p-v table is started.

When the p-v tables have already been calibrated and p-v tables 923 and 924 have been generated and when a button for returning to an initially set value is selected, p-v tables 913 and 914 before calibration (default) are set as the p-v tables used in automatic stop control.

Figure 15:
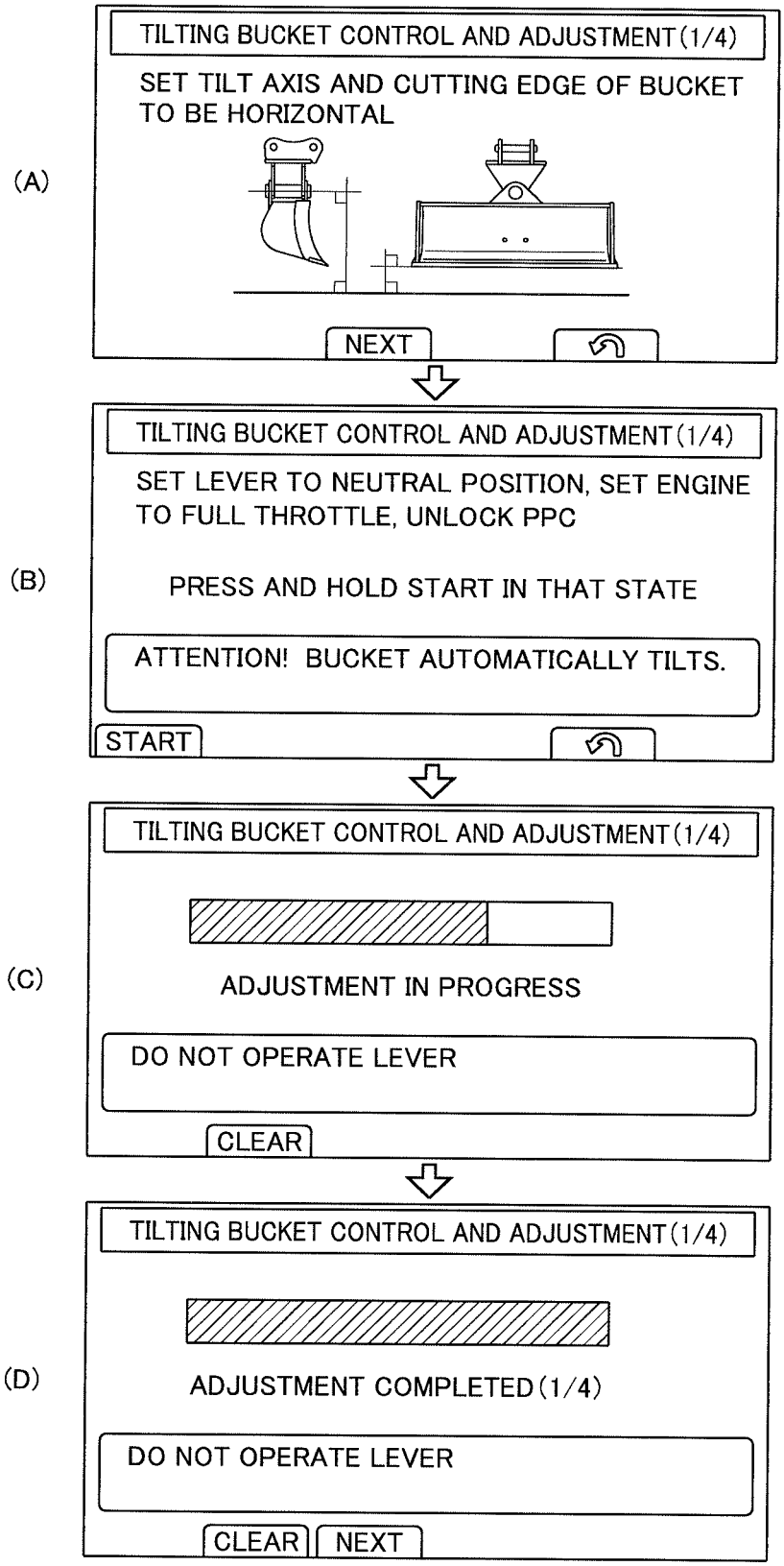
FIG. 15 shows a user interface shown when an adjustment execution button in FIG. 14 is selected.

FIG. 15 shows a user interface shown when the adjustment execution button in FIG. 14 is selected. FIG. 15 shows a user interface shown in detection of a point of start of clockwise movement.

As shown in FIG. 15, monitor apparatus 53 shows guidance instructing an operator to set bucket 107 to the horizontal state in response to an instruction from main controller 52 (state (A)). When main controller 52 determines that bucket 107 is in the horizontal state, it has monitor apparatus 53 show guidance requesting for setting operation lever 51*a* to a neutral position, setting engine 55 to a full throttle state, and unlocking PPC. Thereafter, main controller 52 has monitor apparatus 53 show a user interface indicating adjustment in progress (detection in progress) and completion of adjustment (states (C) and (D)).

Main controller 52 thus detects the point of start of counterclockwise movement. Thereafter, main controller 52 has monitor apparatus 53 show a user interface for calibrating p-v table 913 by using the point of start of clockwise movement and calibrating p-v table 914 by using the point of start of counterclockwise movement.

In detecting the point of start of counterclockwise movement as well, a user interface similar to the user interface shown in detection of the point of start of clockwise movement is shown. Initially, monitor apparatus 53 shows guidance instructing again an operator to set bucket 107 to the horizontal state in response to an instruction from main controller 52. When main controller 52 determines that bucket 107 is in the horizontal state, it has monitor apparatus 53 show guidance requesting for "setting operation lever 51*a* to a neutral position, setting engine 55 to a full throttle state, and unlocking PPC." Thereafter, main controller 52 has monitor apparatus 53 show a user interface indicating adjustment in progress (detection in progress) and completion of adjustment.

Main controller 52 thus detects the point of start of counterclockwise movement. Thereafter, main controller 52 has monitor apparatus 53 show a user interface for calibrating p-v table 913 by using the point of start of clockwise movement and execution of p-v table 914 by using the point of start of counterclockwise movement.

Figure 16:
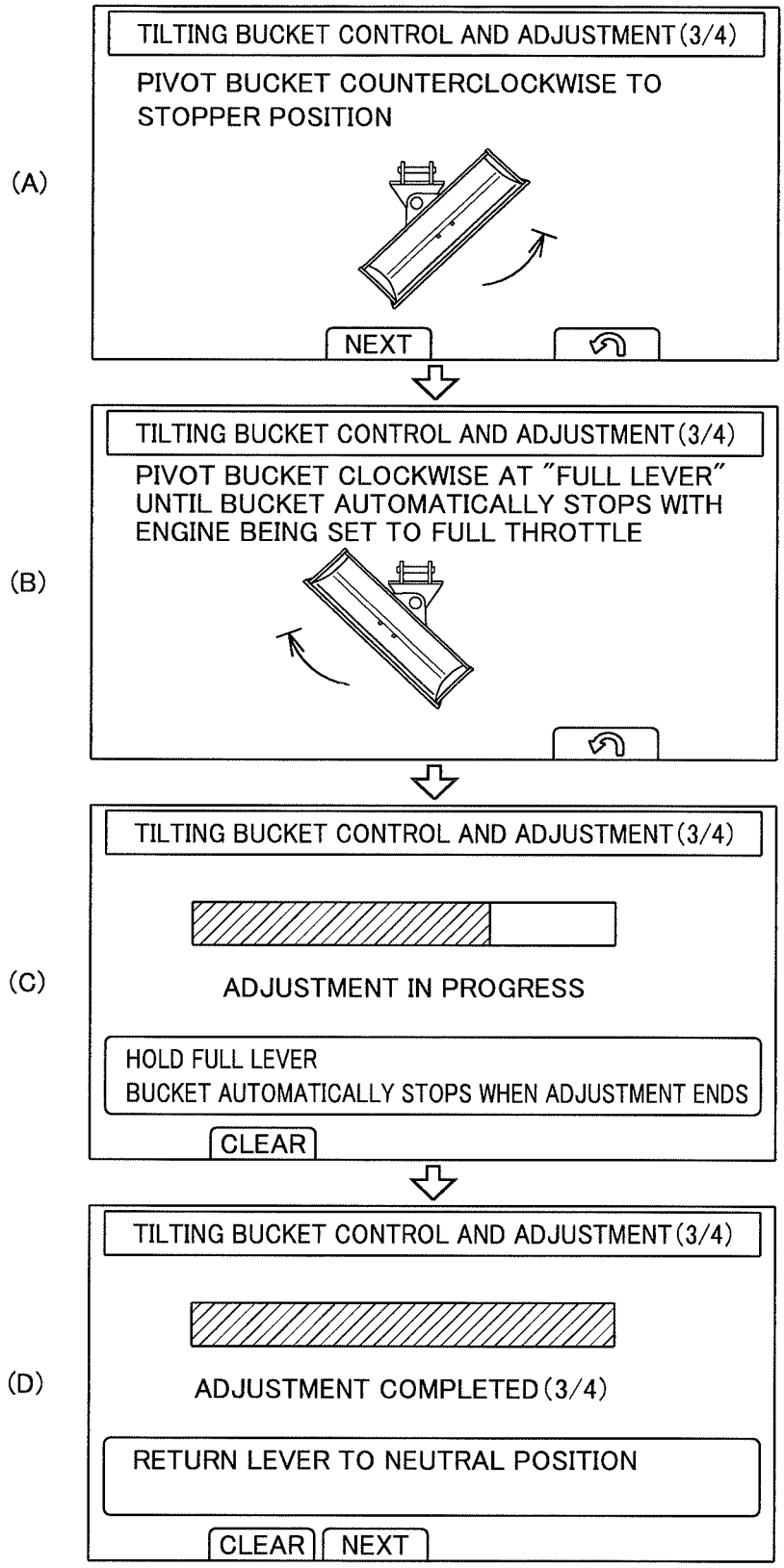
FIG. 16 shows a user interface shown when a p-v table in a clockwise direction is calibrated by using a point of start of clockwise movement.

FIG. 16 shows a user interface shown in calibration of p-v table 913 in the clockwise direction with a point of start of clockwise movement.

As shown in FIG. 16, monitor apparatus 53 shows guidance instructing an operator to have bucket 107 perform a counterclockwise tilting operation to a maximum angle in response to an instruction from main controller 52 (state (A)). When main controller 52 determines that bucket 107 is tilted counterclockwise to the maximum angle, it has monitor apparatus 53 show guidance requesting for "maximizing an amount of operation of operation lever 51*a* while engine 55 is in full throttle and tilting by pivoting clockwise bucket 107." Thereafter, main controller 52 has monitor apparatus 53 show a user interface indicating calibration in progress and completion of calibration (states (C) and (D)).

Thus, calibration of p-v table 913 in the clockwise direction is completed and calibrated p-v table 923 is generated. Thereafter, main controller 52 has monitor apparatus 53 show a user interface for calibrating p-v table 914 in the counterclockwise direction.

In calibration of p-v table 914 in the counterclockwise direction as well, a user interface the same as the user interface shown in calibration of p-v table 913 in the clockwise direction is shown. Initially, monitor apparatus 53 shows guidance instructing an operator to have bucket 107 perform a clockwise tilting operation to the maximum angle in response to an instruction from main controller 52. When main controller 52 determines that bucket 107 is tilted clockwise to the maximum angle, it has monitor apparatus 53 show guidance requesting for "maximizing an amount of operation of operation lever 51*a* while engine 55 is in full throttle and tilting by pivoting counterclockwise bucket 107." Thereafter, main controller 52 has monitor apparatus 53 show a user interface indicating calibration in progress and completion of calibration.

Calibration of p-v table 914 in the counterclockwise direction is thus completed and calibrated p-v table 924 is generated. As set forth above, a series of calibration processes ends.

<F. Control Structure>

Figure 17:
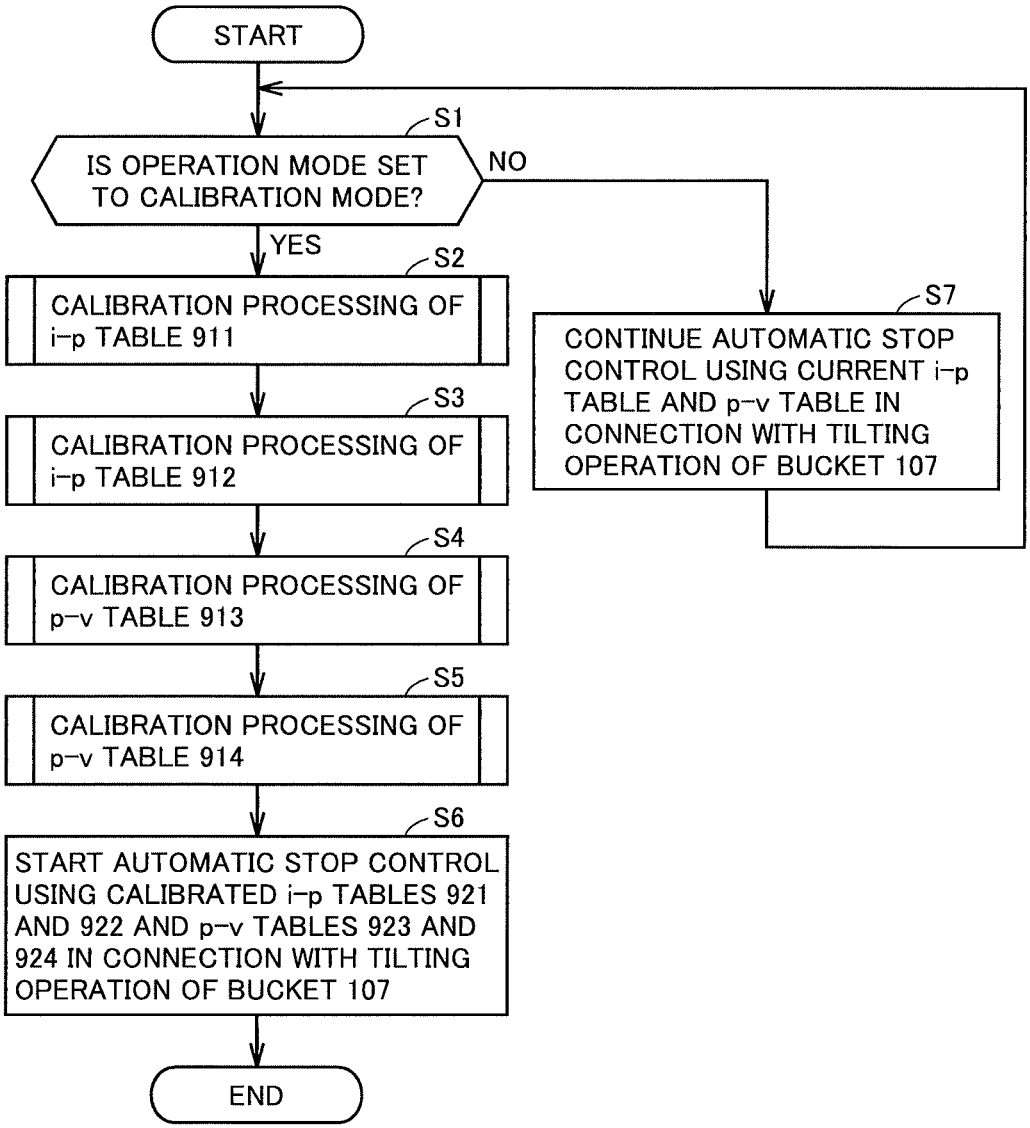
FIG. 17 is a flowchart for illustrating a flow of overall processing in the work vehicle.

FIG. 17 is a flowchart for illustrating a flow of overall processing in work vehicle 100. A flow of processing in an aspect in which a serviceperson and a specific manager described above perform calibration processing will be described below.

Referring to FIG. 17, main controller 52 determines whether or not the operation mode of work vehicle 100 is set to the calibration mode. When main controller 52 determines that the operation mode is not set to the calibration mode (NO in step S1), main controller 52 carries out in step S7 automatic stop control using current i-p tables and p-v tables in connection with the tilting operation of bucket 107.

For example, when calibration processing has not been performed once, main controller 52 carries out automatic stop control making use of i-p tables 911 and 912 and p-v tables 913 and 914. When calibration processing has already been performed, main controller 52 carries out automatic stop control making use of i-p tables 921 and 922 and p-v tables 923 and 924.

When main controller 52 determines that the operation mode is set to the calibration mode (YES in step S1), it performs calibration processing of default i-p table 911 in step S2. Even when i-p table 911 has already been calibrated and i-p table 921 has been generated, main controller 52 performs calibration processing of default i-p table 911.

Main controller 52 performs calibration processing of default i-p table 912 in step S3. Main controller 52 performs calibration processing of default p-v table 913 in step S4. Main controller 52 performs calibration processing of default p-v table 914 in step S5.

When calibration of i-p tables 911 and 912 and p-v tables 913 and 914 ends, main controller 52 starts in step S6 automatic stop control making use of calibrated i-p tables 921 and 922 and p-v tables 923 and 924 in connection with the tilting operation of bucket 107.

When a general operator not having prescribed authorization like a serviceperson performs calibration processing, processing in step S2 and step S3 is not performed.

Figure 18:
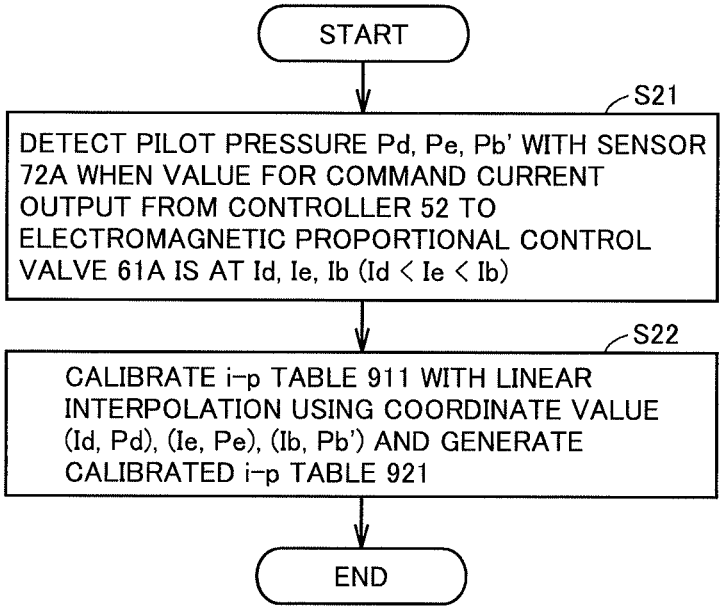
FIG. 18 is a flowchart for illustrating details of processing in step S2 in FIG. 17.

FIG. 18 is a flowchart for illustrating details of processing in step S2 in FIG. 17. Referring to FIG. 18, in step S21, main controller 52 detects with sensor 72A, each of pilot pressures Pd, Pe, and Pb' at the time when a value for a command current output from main controller 52 to electromagnetic proportional control valve 61A is set to each of Id, Ie, and Ib. In step S22, main controller 52 calibrates i-p table 911 with linear interpolation using three coordinate values (Id, Pd), (Ie, Pe), and (Ib, Pb') and generates calibrated i-p table 921.

In step S3 in FIG. 17, main controller 52 detects with sensor 72B, each of pilot pressures Pd, Pe, and Pb' at the time when a value for a command current output from main controller 52 to electromagnetic proportional control valve 61B is set to each of Id, Ie, and Ib. Then, main controller 52 calibrates i-p table 912 with linear interpolation using three coordinate values (Id, Pd), (Ie, Pe), and (Ib, Pb') and generates calibrated i-p table 922.

Figure 19:
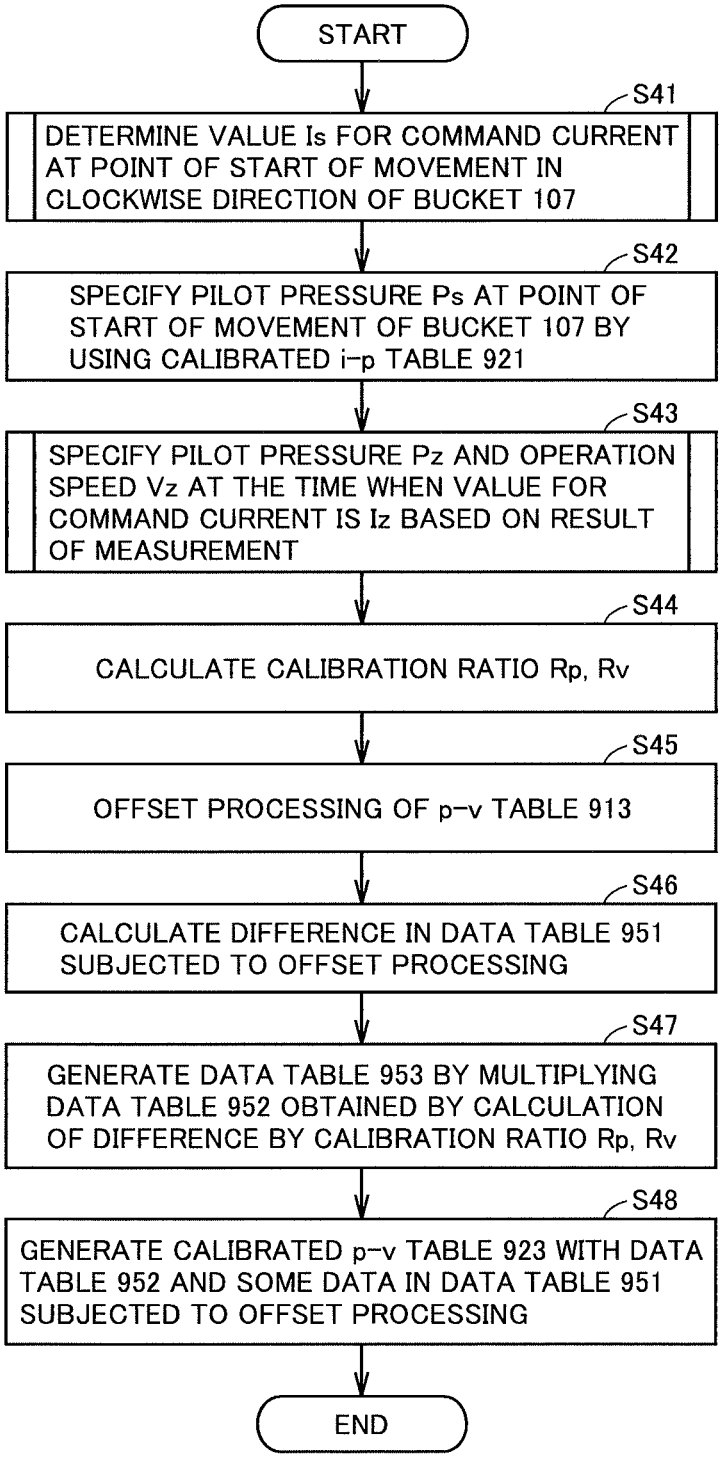
FIG. 19 is a flowchart for illustrating details of processing in step S4 in FIG. 17.

FIG. 19 is a flowchart for illustrating details of processing in step S4 in FIG. 17.

Referring to FIG. 19, in step S41, main controller 52 determines value Is for a command current at the point of start of clockwise movement of bucket 107. In step S42, main controller 52 specifies pilot pressure Ps at the point of start of clockwise movement of bucket 107 with calibrated i-p table 921. In step S43, main controller 52 specifies a pilot pressure and operation speed Vz of tilt cylinder 13A at the time when a value for the command current is set to Iz based on a result of measurement.

In step S44, main controller 52 calculates calibration ratios Rp and Rv. In step S45, main controller 52 performs the offset processing described above of p-v table 913. In step S46, main controller 52 calculates a difference in data table 951 (FIG. 11(A)) subjected to the offset processing.

In step S47, main controller 52 generates differential data 953 (FIG. 12(A)) by multiplying data table 952 (FIG. 11(B)) obtained by calculation of the difference in step S46 by calibration ratio Rp or Rv. In step S48, main controller 52 generates calibrated p-v table 923 by using differential data 953 and some of data in data table 951 subjected to the offset processing.

In step S5 in FIG. 17, processing below is performed as in step S4. Main controller 52 determines value Is for a command current at the point of start of counterclockwise movement of bucket 107. Main controller 52 specifies pilot pressure Ps at the point of start of counterclockwise movement of bucket 107 with calibrated i-p table 922. Main controller 52 specifies a pilot pressure and operation speed Vz of tilt cylinder 13B at the time when a value for a command current is set to Iz based on a result of measurement. Main controller 52 calculates calibration ratios Rp and Rv. Main controller 52 performs the offset processing described above of p-v table 914. Main controller 52 calculates a difference in the data table subjected to the offset processing. Main controller 52 generates a data table by multiplying the data table obtained by calculation of the difference by calibration ratio Rp or Rv. Main controller 52 generates calibrated p-v table 924 by using the data table generated by multiplication by calibration ratio Rp or Rv and some of data in the data table subjected to the offset processing.

Figure 20:
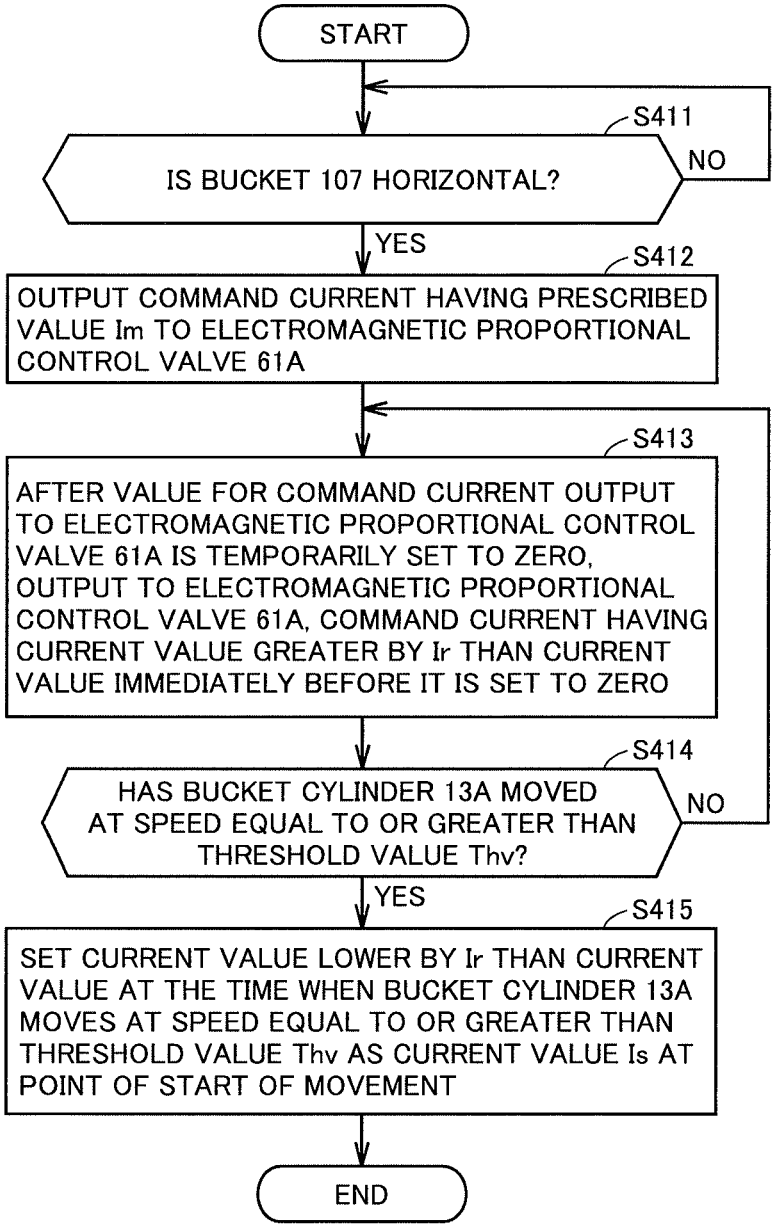
FIG. 20 is a flowchart for illustrating details of processing in step S41 in FIG. 19.

FIG. 20 is a flowchart for illustrating details of processing in step S41 in FIG. 19.

Referring to FIG. 20, in step S411, main controller 52 determines whether or not bucket 107 is in the horizontal state. When main controller 52 determines that bucket 107 is in the horizontal state (YES in step S411), it outputs a command current having prescribed value Im (FIG. 9) to electromagnetic proportional control valve 61A in step S412. When bucket 107 is not in the horizontal state (step S411), main controller 52 returns the process to step S411 and stands by until bucket 107 is in the horizontal state.

In step S413, main controller 52 temporarily sets a value for a command current output to electromagnetic proportional control valve 61A to zero and thereafter outputs a command current having a value greater by Ir than the current value immediately before it is set to zero to electromagnetic proportional control valve 61A.

In step S414, main controller 52 determines whether or not tilt cylinder 13A has moved at a speed equal to or greater than threshold value Thy. When main controller 52 determines that tilt cylinder 13A has not moved at a speed equal to or greater than threshold value Thv (NO in step S414), the process returns to step S413 in order to further increase by Ir a value for a command current.

When main controller 52 determines that tilt cylinder 13A has moved at a speed equal to or greater than threshold value Thv (YES in step S414), it sets in step S415 a current value lower by Ir than the current value at the time when tilt cylinder 13A has moved at the speed equal to or greater than threshold value Thv as current value Is at the point of start of movement.

Figure 21:
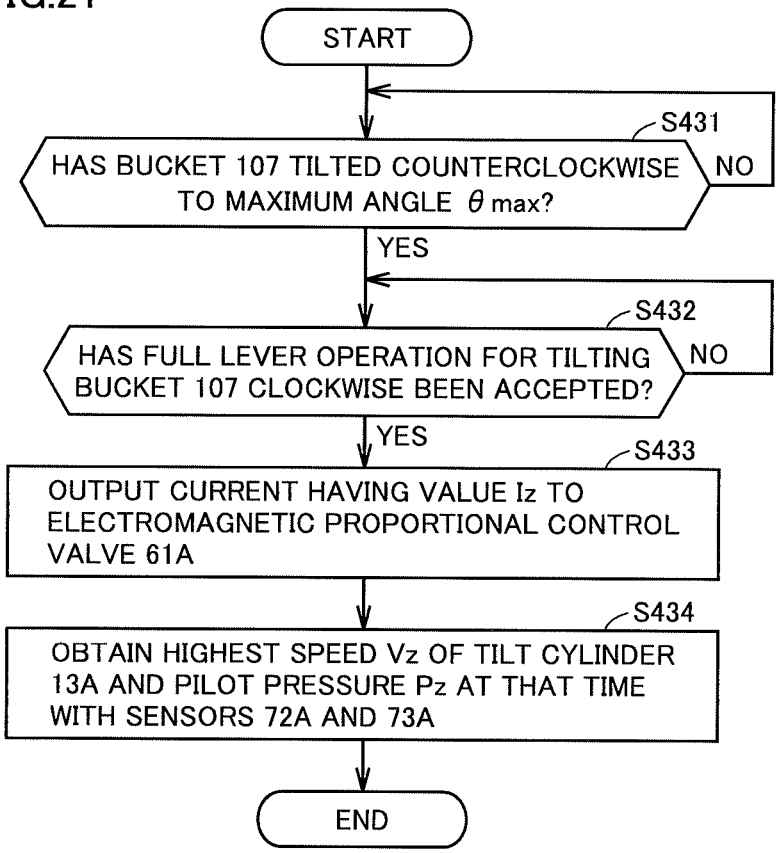
FIG. 21 is a flowchart for illustrating details of processing in step S43 in FIG. 19.

FIG. 21 is a flowchart for illustrating details of processing in step S43 in FIG. 19.

Referring to FIG. 21, in step S431, main controller 52 determines whether or not bucket 107 has been tilted counterclockwise to maximum angle θmax. When main controller 52 determines that bucket 107 has been tilted counterclockwise to maximum angle θmax (YES in step S431), it determines in step S432 whether or not it has accepted a full lever operation for having bucket 107 perform the clockwise tilting operation. When main controller 52 determines that bucket 107 has not been tilted counterclockwise to maximum angle θmax (NO in step S431), the process returns to step S431.

When main controller 52 determines that it has accepted the full lever operation (YES in step S432), it outputs a command current having value Iz to electromagnetic proportional control valve 61A in step S433. When main controller 52 determines that it has not accepted the full lever operation (NO in step S432), the process returns to step S432.

In step S434, main controller 52 obtains highest speed Vz of tilt cylinder 13A and pilot pressure Pz at that time with sensors 72A and 73A.

<G. Modification>

A modification of work vehicle 100 will be described below.

(1) In the embodiment above, specifying unit 85 finds current value Is at the point of start of movement and determines pilot pressure Ps corresponding to current value Is with calibrated i-p tables 921 and 922. As described with reference to FIGS. 10 to 12, p-v tables 913 and 914 are calibrated with pilot pressure Ps. Limitation thereto, however, is not intended. Other processing examples will be described below.

As a current value is increased by current value control unit 81, calibration unit 83 specifies a pilot pressure at the time when bucket 107 starts moving clockwise based on outputs from sensor 73A and sensor 72A. For example, calibration unit 83 specifies a pilot pressure at the time when an average operation speed of tilt cylinder 13A exceeds threshold value Thv (mm/sec). Calibration unit 83 calibrates p-v table 913 based on the specified pilot pressure. Specifically, the specified pilot pressure is used as pilot pressure Ps.

As a current value is increased by current value control unit 81, calibration unit 83 specifies a pilot pressure at the time when bucket 107 starts moving counterclockwise based on outputs from sensor 73B and sensor 72B. For example, calibration unit 83 specifies a pilot pressure at the time when an average operation speed of tilt cylinder 13B exceeds threshold value Thv (mm/sec). Calibration unit 83 calibrates p-v table 914 based on the specified pilot pressure. Specifically, the specified pilot pressure is used as pilot pressure Ps.

According to such a configuration as well, calibration unit 83 can calibrate p-v tables 913 and 914.

(2) In the embodiment above, though description has been given with attention being paid to i-p tables 911 and 912 and p-v tables 913 and 914 in connection with the tilting operation of bucket 107, limitation to these tables is not intended. The technique for calibration of data described above can widely be applied to data for predicting an operation speed of work implement 104.

For example, the technique for calibrating data described above is applicable to an operation speed of boom 105, an operation speed of arm 106, an operation speed of bucket 107 at the time when bucket cylinder 12 is operated, and data for predicting a speed of revolution of revolving unit 103.

(3) In the embodiment above, main controller 52 calibrates i-p tables with linear interpolation using three coordinate values (Id, Pd), (Ie, Pe), and (Ib, Pb') and generates calibrated i-p tables. Limitation thereto, however, is not intended, and calibrated i-p tables may be generated by using four or more coordinate values.

(4) In the above, i-p data (data defining relation between a value for a command current and a pilot pressure generated by an electromagnetic proportional control valve) and p-v data (data defining relation between a pilot pressure and an operation speed of a tilt cylinder) have been described by way of example of data for predicting an operation speed of a work implement. I-p data, p-st data (data defining relation between a pilot pressure and a stroke length of a spool), and st-v data (data defining relation between a stroke length and an operation speed of a tilt cylinder), however, may be included as data for predicting an operation speed of a work implement. In this case, work vehicle 100 should include a sensor measuring a stroke length of a spool.

(5) Though electronic operation apparatus 51 has been described above by way of example, limitation thereto is not intended, and a hydraulic apparatus outputting a pilot pressure in accordance with a direction of operation and an amount of operation of an operation lever may be applicable.

(6) After bucket 107 is tilted by maximum angle θmax, a pilot pressure and an operation speed (a highest speed of an operation speed) of tilt cylinder 13A at the time when a current value is set to Iz are measured, however, bucket 107 does not necessarily have to perform a tilting operation by maximum angle θmax. So long as a highest speed of the tilting operation is obtained by the time tilt cylinders 13A and 13B reach a stroke end when current value Iz is output to an electromagnetic proportional control valve, bucket 107 does not have to perform a tilting operation by maximum angle θmax.

(7) Though work vehicle 100 includes two tilt cylinders 13A and 13B by way of example in the embodiment above, a single tilt cylinder may be provided.

<H. Advantages>

A main construction of work vehicle 100 and advantages obtained by such a construction will be described below with reference to modifications. Names of members in parentheses and references in parentheses below show examples of members to which the parentheses are provided.

(1) Work vehicle 100 includes bucket 107, main valves 62A and 62B adjusting flow rates of a hydraulic oil having bucket 107 perform a tilting operation, electromagnetic proportional control valves 61A and 61B generating pilot pressures guided to main valves 62A and 62B, main controller 52 outputting a current to the electromagnetic proportional control valve (61A, 61B), and a first sensor (73A, 73B) for detecting an operation of bucket 107. Main controller 52 includes storage unit 90 storing data (i-p tables 911 and 912 and p-v tables 913 and 914) for predicting an operation speed of bucket 107 in the tilting operation, detection unit 86 detecting a horizontal state of bucket 107 based on outputs from sensors 73A and 73B, and calibration unit 83 adjusting a current value of the current output to the electromagnetic proportional control valve after detection of the horizontal state of bucket 107 and starting calibration of the data.

According to such a configuration, after bucket 107 is in the horizontal state, a value for a current output to the electromagnetic proportional control valve is adjusted and calibration of data for predicting an operation speed of bucket 107 in the tilting operation is started. Therefore, work vehicle 100 can calibrate data without being affected by gravity applied to bucket 107. Therefore, the work vehicle can accurately calibrate data.

(2) Bucket 107 tilts by pivoting around pivot axis AX orthogonal to bucket pin 16. Calibration unit 83 adjusts a current value of the current output to the electromagnetic proportional control valve (61A, 61B) after detection of the horizontal state of cutting edge 1071*a* of bucket 107 and pivot axis AX and starts calibration of the data.

According to such a configuration, work vehicle 100 can calibrate the data as being affected less by the gravity applied to the bucket than when pivot axis AX is not horizontal.

(3) Work vehicle 100 further includes a second sensor (72A, 72B) measuring the pilot pressure generated by the electromagnetic proportional control valve (61A, 61B).

Main controller 52 further includes current value control unit 81 increasing the current value of the current output to the electromagnetic proportional control valve after detection of the horizontal state of bucket 107. Calibration unit 83 specifies the pilot pressure at the time when bucket 107 starts moving based on outputs from the first sensor (73A, 73B) and the second sensor (72A, 72B) with increase in current value by current value control unit 81. Calibration unit 83 calibrates the data (p-v tables 913 and 914) with the specified pilot pressure.

According to such a configuration, work vehicle 100 can calibrate data for predicting a speed of the tilting operation with the pilot pressure generated by the electromagnetic proportional control valve.

(4) The data includes first data (i-p tables 911 and 912) defining relation between a current value of the current output to the electromagnetic proportional control valve and a pilot pressure generated by the electromagnetic proportional control valve. Main controller 52 further includes current value control unit 81 increasing a current value of the current output to the electromagnetic proportional control valve (61A, 61B) after detection of the horizontal state of bucket 107. Calibration unit 83 specifies current value Is at the time when bucket 107 starts the tilting operation based on a result of detection by the first sensor (73A, 73B) with increase in current value by current value control unit 81. Main controller 52 determines pilot pressure Ps corresponding to the specified current value based on i-p tables 911 and 912. Main controller 52 calibrates the data (specifically, p-v tables 913 and 914) with specified pilot pressure Ps.

According to such a configuration, work vehicle 100 can calibrate data for predicting an operation speed of bucket 107 in the tilting operation with the specified current value and the first data (i-p tables 911 and 912) defining relation between a value for the current output to the electromagnetic proportional control valve and a pilot pressure generated by the electromagnetic proportional control valve.

(5) Bucket 107 can perform clockwise and counterclockwise tilting operations. Calibration unit 83 specifies a current value at the time when bucket 107 starts the clockwise tilting operation and a current value at the time when bucket 107 starts the counterclockwise tilting operation.

According to such a configuration, the work vehicle can measure a value for a command current at the time when bucket 107 starts the clockwise tilting operation and a value for a command current at the time when bucket 107 starts the counterclockwise tilting operation.

(6) Work vehicle 100 further includes a cylinder for having bucket 107 perform the tilting operation. The cylinder includes tilt cylinder 13A having bucket 107 perform the clockwise tilting operation by extending and tilt cylinder 13B having bucket 107 perform the counterclockwise tilting operation by extending. The main valve includes main valve 62A adjusting a flow rate of the hydraulic oil supplied to tilt cylinder 13A and main valve 62B adjusting a flow rate of the hydraulic oil supplied to tilt cylinder 13B. The electromagnetic proportional control valve (61A, 61B) includes electromagnetic proportional control valve 61A generating a pilot pressure guided to main valve 62A and electromagnetic proportional control valve 61B generating a pilot pressure guided to main valve 62B. Current value control unit 81 increases a current value of the current output to electromagnetic proportional control valve 61B after it increases a current value of the current output to electromagnetic proportional control valve 61A.

According to such a configuration, the work vehicle can specify a current value (Is) at the time when bucket 107 starts the clockwise tilting operation, of the command current output to electromagnetic proportional control valve 61A for having bucket 107 perform the clockwise tilting operation. The work vehicle can specify a current value (Is) at the time when bucket 107 starts the counterclockwise tilting operation, of the command current output to electromagnetic proportional control valve 61B for having bucket 107 perform the counterclockwise tilting operation.

(7) Work vehicle 100 further includes operation apparatus 51 for operating bucket 107. The data includes second data (p-v table 913) defining relation between the pilot pressure and an operation speed of tilt cylinder 13A and third data (p-v table 914) defining relation between the pilot pressure and an operation speed of tilt cylinder 13B. Calibration unit 83 calibrates the second data and the third data on the condition that operation apparatus 51 accepts an operation for having bucket 107 perform the tilting operation.

According to such a configuration, on the condition that an operation onto operation apparatus 51 is performed, the second data and the third data are calibrated. Therefore, work vehicle 100 can calibrate data for predicting an operation speed of bucket 107 in the tilting operation with an intention of an operator being accurately reflected.

(8) Current value control unit 81 predicts a speed of the tilting operation of bucket 107 by using the second data (p-v table 913) and the third data (p-v table 914) on the condition that an operation mode of work vehicle 100 is set to the normal mode and restricts current values of the currents output to electromagnetic proportional control valves 61A and 61B based on a result of prediction. Current value control unit 81 increases the current values of the currents output to electromagnetic proportional control valves 61A and 61B after detection of the horizontal state of bucket 107 on the condition that the operation mode of work vehicle 100 is set to the calibration mode.

According to such a configuration, when work vehicle 100 is set to the normal mode, predictive control using the second data and the third data is carried out. When work vehicle 100 is set to the calibration mode, a value for a command current at the time when bucket 107 starts the tilting operation can be measured.

Embodiments disclosed herein are illustrative and not restricted only to the contents above. The scope of the present invention is defined by the terms of the claims and is intended to include any modifications within the scope and meaning equivalent to the terms of the claims.

REFERENCE SIGNS LIST

10 boom cylinder; 11 arm cylinder; 12 bucket cylinder; 13A, 13B tilt cylinder; 14 boom pin; 15 arm pin; 16 bucket pin; 17 tilt pin; 51 operation apparatus; 51*a* operation lever; 51*b* operation detector; 52 main controller; 55 engine; 56 hydraulic pump; 56A main pump; 56B pilot pump; 57 swash plate driving apparatus; 59 pilot oil path; 61A, 61B electromagnetic proportional control valve; 62A, 62B main valve; 71A, 71B, 72A, 72B, 73A, 73B sensor; 80 control unit, 81 current value control unit; 82 operation mode switching unit; 83 calibration unit; 84 speed prediction unit; 85 specifying unit; 86 detection unit; 90 storage unit; 91 data storage unit; 100 work vehicle; 101 travel unit; 103 revolving unit; 104 work implement; 105 boom; 106 arm; 107 bucket; 109 coupling member; 621 spool; 622 pilot chamber; 911, 912, 921, 922 i-p table; 913, 914, 923, 924 p-v table; 951, 952 data table; 953 differential data; 1071 blade; 1071*a* cutting edge; AX pivot axis; and B1, B2, B3 coordinate point.

The invention claimed is:

1. A work vehicle comprising:

a bucket;

a valve adjusting a flow rate of a hydraulic oil having the bucket perform a tilting operation;

an electromagnetic proportional control valve generating a pilot pressure guided to the valve;

a controller outputting a current to the electromagnetic proportional control valve; and a first sensor for detecting the tilting operation, the controller including a storage unit storing data for predicting an operation speed of the bucket in the tilting operation, a detection unit detecting a horizontal state of the bucket based on an output from the first sensor, and a calibration unit adjusting a current value of the current output to the electromagnetic proportional control valve after detection of the horizontal state of the bucket and starting calibration of the data.

2. The work vehicle according to claim 1, wherein the bucket performs the tilting operation by pivoting around a pivot axis orthogonal to a bucket pin, and the calibration unit adjusts the current value of the current output to the electromagnetic proportional control valve after detection of the horizontal state of a cutting edge of the bucket and the pivot axis and starts calibration of the data.

3. The work vehicle according to claim 1, further comprising a second sensor measuring the pilot pressure generated by the electromagnetic proportional control valve, wherein the controller further includes a current value control unit increasing the current value of the current output to the electromagnetic proportional control valve after detection of the horizontal state of the bucket, and the calibration unit specifies the pilot pressure when the bucket starts moving based on outputs from the first sensor and the second sensor with increase in current value by the current value control unit and calibrates the data with the specified pilot pressure.

4. The work vehicle according to claim 1, wherein the data includes first data defining relation between the current value of the current output to the electromagnetic proportional control valve and the pilot pressure generated by the electromagnetic proportional control valve, the controller further includes a current value control unit increasing the current value of the current output to the electromagnetic proportional control valve after detection of the horizontal state of the bucket, and the calibration unit specifies the current value when the bucket starts the tilting operation based on a result of detection by the first sensor with increase in current value by the current value control unit, specifies the pilot pressure corresponding to the specified current value based on the first data, and calibrates the data with the specified pilot pressure.

5. The work vehicle according to claim 4, wherein the bucket can perform the tilting operation in a first direction and a second direction opposite to the first direction, and the calibration unit specifies the current value when the bucket starts the tilting operation in the first direction and the current value when the bucket starts the tilting operation in the second direction.

6. The work vehicle according to claim 3, further comprising a cylinder for having the bucket perform the tilting operation, wherein the cylinder includes a first cylinder having the bucket perform the tilting operation in a first direction by extending and a second cylinder having the bucket perform the tilting operation in a second direction opposite to the first direction by extending, the valve includes a first valve adjusting a flow rate of the hydraulic oil supplied to the first cylinder and a second valve adjusting a flow rate of the hydraulic oil supplied to the second cylinder, the electromagnetic proportional control valve includes a first electromagnetic proportional control valve generating a pilot pressure guided to the first valve and a second electromagnetic proportional control valve generating a pilot pressure guided to the second valve, and the current value control unit increases a current value of the current output to the second electromagnetic proportional control valve after the current value control unit increases a current value of the current output to the first electromagnetic proportional control valve.

7. The work vehicle according to claim 6, further comprising an operation apparatus for operating the bucket, wherein the data includes second data defining relation between the pilot pressure and an operation speed of the first cylinder and third data defining relation between the pilot pressure and an operation speed of the second cylinder, and the calibration unit calibrates the second data and the third data on condition that the operation apparatus accepts an operation for having the bucket perform the tilting operation.

8. The work vehicle according to claim 7, wherein the current value control unit predicts the operation speed of the bucket in the tilting operation by using the second data and the third data on condition that an operation mode of the work vehicle is set to a first operation mode and restricts the current value of the current output to the electromagnetic proportional control valve based on a result of prediction, and increases the current value of the current output to the electromagnetic proportional control valve after detection of the horizontal state of the bucket on condition that the operation mode of the work vehicle is set to a second operation mode.

9. The work vehicle according to claim 4, further comprising a cylinder for having the bucket perform the tilting operation, wherein the cylinder includes a first cylinder having the bucket perform the tilting operation in a first direction by extending and a second cylinder having the bucket perform the tilting operation in a second direction opposite to the first direction by extending, the valve includes a first valve adjusting a flow rate of the hydraulic oil supplied to the first cylinder and a second valve adjusting a flow rate of the hydraulic oil supplied to the second cylinder, the electromagnetic proportional control valve includes a first electromagnetic proportional control valve generating a pilot pressure guided to the first valve and a second electromagnetic proportional control valve generating a pilot pressure guided to the second valve, and the current value control unit increases a current value of the current output to the second electromagnetic proportional control valve after the current value control unit increases a current value of the current output to the first electromagnetic proportional control valve.

10. The work vehicle according to claim 9, further comprising an operation apparatus for operating the bucket, wherein the data includes second data defining relation between the pilot pressure and an operation speed of the first cylinder and third data defining relation between the pilot pressure and an operation speed of the second cylinder, and the calibration unit calibrates the second data and the third data on condition that the operation apparatus accepts an operation for having the bucket perform the tilting operation.

11. The work vehicle according to claim 10, wherein the current value control unit predicts the operation speed of the bucket in the tilting operation by using the second data and the third data on condition that an operation mode of the work vehicle is set to a first operation mode and restricts the current value of the current output to the electromagnetic proportional control valve based on a result of prediction, and increases the current value of the current output to the electromagnetic proportional control valve after detection of the horizontal state of the bucket on condition that the operation mode of the work vehicle is set to a second operation mode.

12. A control method in a work vehicle, the work vehicle including a bucket, a valve adjusting a flow rate of a hydraulic oil having the bucket perform a tilting operation, an electromagnetic proportional control valve generating a pilot pressure guided to the valve, a controller outputting a current to the electromagnetic proportional control valve, and a sensor for detecting the tilting operation, the control method comprising:

detecting, by the controller, a horizontal state of the bucket; and adjusting, by the controller, a current value of the current output to the electromagnetic proportional control valve after detection of the horizontal state of the bucket and starting calibration of data for predicting an operation speed of the bucket in the tilting operation.

* * * * *